US006305600B1

(12) United States Patent
Hirschey et al.

(10) Patent No.: US 6,305,600 B1
(45) Date of Patent: Oct. 23, 2001

(54) CARTON HAVING A PREFOLDED INTERIOR PAPER LINING AND A METHOD OF PREPARING A CARTON WITH A PREFOLDED INTERIOR PAPER LINING

(75) Inventors: Urban C. Hirschey, Carthage, NY (US); Mark U. Hirschey, Brookline, MA (US); Timothy H. Everson, Sr., Lowville, NY (US)

(73) Assignee: Climax Manufacturing Co., Lowville, NY (US)

( * ) Notice: Subject to any disclaimer, the term of this patent is extended or adjusted under 35 U.S.C. 154(b) by 0 days.

(21) Appl. No.: 09/382,595

(22) Filed: Aug. 25, 1999

Related U.S. Application Data

(62) Division of application No. 08/683,730, filed on Jul. 18, 1996.

(51) Int. Cl.[7] ..... B05D 5/56

(52) U.S. Cl. ..... 229/164.2; 229/117.07; 229/117.27; 229/117.28; 229/87.01; 229/87.18; 229/87.19

(58) Field of Search ..... 229/164.2, 117.07, 229/117.27, 117.28, 87.01, 87.18, 87.19, 87.11

(56) References Cited

U.S. PATENT DOCUMENTS

| | | | | |
|---|---|---|---|---|
| 1,180,188 | | 4/1916 | Retzbach . | |
| 1,465,581 | | 8/1923 | Johnson . | |
| 1,907,082 | | 5/1933 | Meltzer . | |
| 1,986,263 | * | 1/1935 | Hatch | 229/164.12 X |
| 2,006,705 | | 7/1935 | Bangs . | |
| 2,333,943 | * | 11/1943 | Levkoff | 229/164.2 |
| 2,389,291 | | 11/1945 | Bergstein . | |
| 2,544,101 | | 3/1951 | Oxley . | |
| 2,805,973 | | 9/1957 | Klasing et al. . | |
| 2,849,322 | * | 8/1958 | Brucker | 229/87.11 |
| 3,142,231 | | 7/1964 | Christensson . | |
| 3,147,675 | | 9/1964 | Cherrin . | |
| 3,223,816 | | 12/1965 | Cherrin . | |
| 3,459,357 | | 8/1969 | Egger et al. . | |
| 3,490,581 | * | 1/1970 | Desmond et al. | 229/117.27 |
| 3,506,180 | * | 4/1970 | Forrest | 229/117.28 |
| 3,519,160 | * | 7/1970 | Lorenz, Jr. et al. | 229/164.2 |
| 3,640,447 | * | 2/1972 | Forbes, Jr. et al. | 229/117.31 |
| 3,698,594 | | 10/1972 | Boehlert . | |
| 3,777,925 | | 12/1973 | Eckholm . | |
| 3,861,504 | | 1/1975 | McGraw . | |
| 3,878,771 | | 4/1975 | Malcolm . | |
| 4,111,412 | | 9/1978 | Cathers . | |
| 4,186,845 | | 2/1980 | Podd et al. . | |
| 4,186,955 | * | 2/1980 | Campbell | 229/117.07 X |
| 4,339,034 | * | 7/1982 | Panveno | 206/313 |
| 4,571,232 | * | 2/1986 | Diehl | 229/87.18 |
| 4,611,350 | | 9/1986 | Kaczerwaski . | |
| 4,658,989 | | 4/1987 | Bonerb . | |
| 4,674,127 | | 6/1987 | Yamada et al. . | |

(List continued on next page.)

OTHER PUBLICATIONS

Card Model FAQ, pp. 1 and 125.*

*Primary Examiner*—Allan N. Shoap
*Assistant Examiner*—Tri M. Mai
(74) *Attorney, Agent, or Firm*—Finnegan, Henderson, Farabow, Garrett & Dunner, L.L.P.

(57) ABSTRACT

A method of preparing a carton with a prefolded interior paper lining includes feeding carton blanks having a surface, the surface having leading and trailing edges and right and left side edges, feeding a paper web, folding the paper web to have a base portion having an edge and at least a first flap joining the base portion at a first crease, cutting a section off the paper web, and inserting the paper section with the carton blank surface, such that the edge and crease of the base portion of the paper are spaced a predetermined distance inward from each respective carton blank side edge.

12 Claims, 32 Drawing Sheets

U.S. PATENT DOCUMENTS

| | | | | |
|---|---|---|---|---|
| 5,040,693 | | 8/1991 | Podd, Sr. et al. . | |
| 5,263,339 | | 11/1993 | Evans . | |
| 5,265,799 | | 11/1993 | Stone . | |
| 5,306,372 | * | 4/1994 | Hall et al. | 229/87.19 |
| 5,429,576 | | 7/1995 | Doderer-Winkler . | |
| 5,518,174 | * | 5/1996 | Botterman | 229/164.2 |
| 5,538,155 | | 7/1996 | Hoekstra . | |
| 5,794,811 | | 8/1998 | Walsh . | |
| 5,918,799 | * | 7/1999 | Walsh | 229/164.2 |
| 5,944,251 | | 8/1999 | LaFleur . | |

* cited by examiner

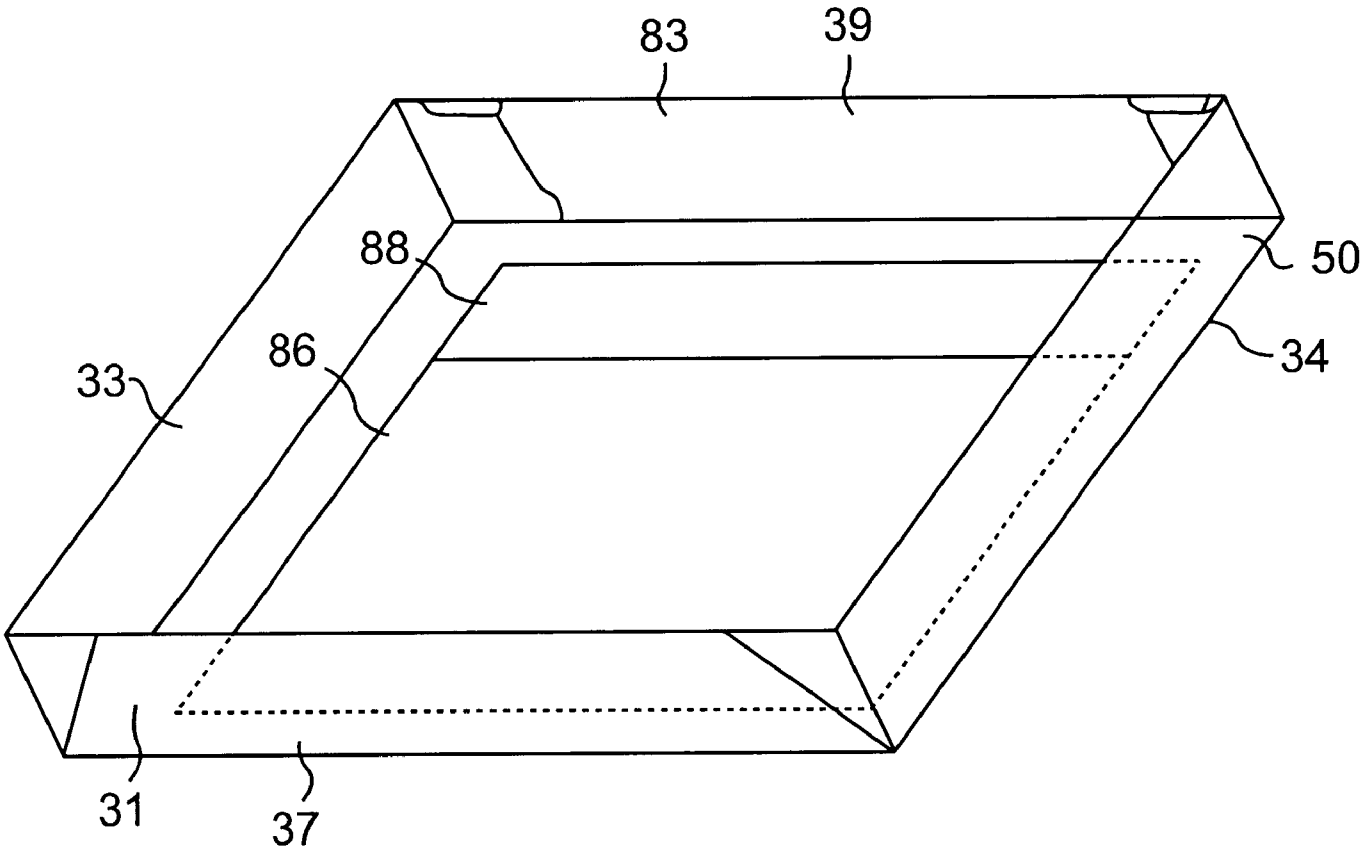
FIG. 7a1

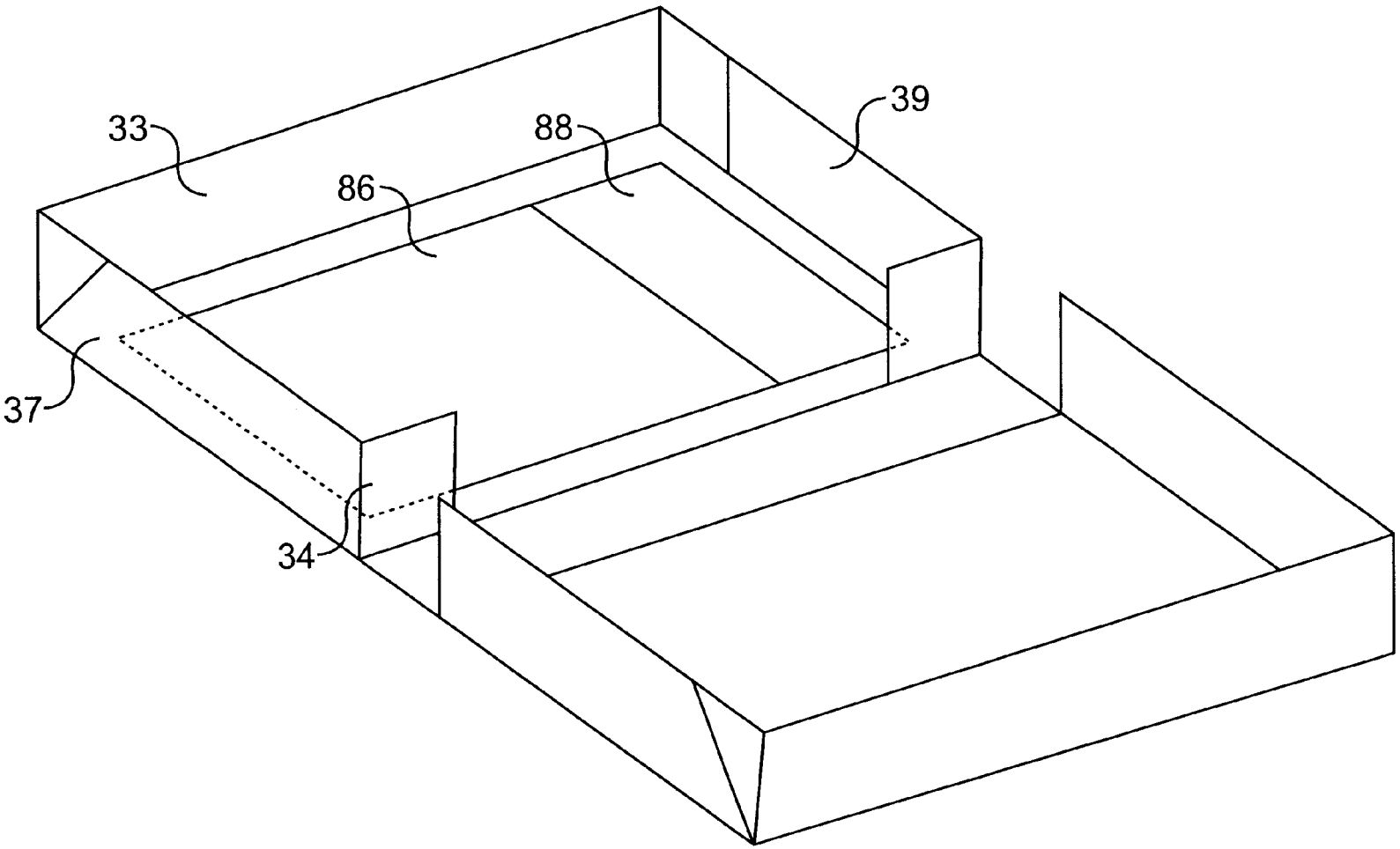
FIG. 7b1

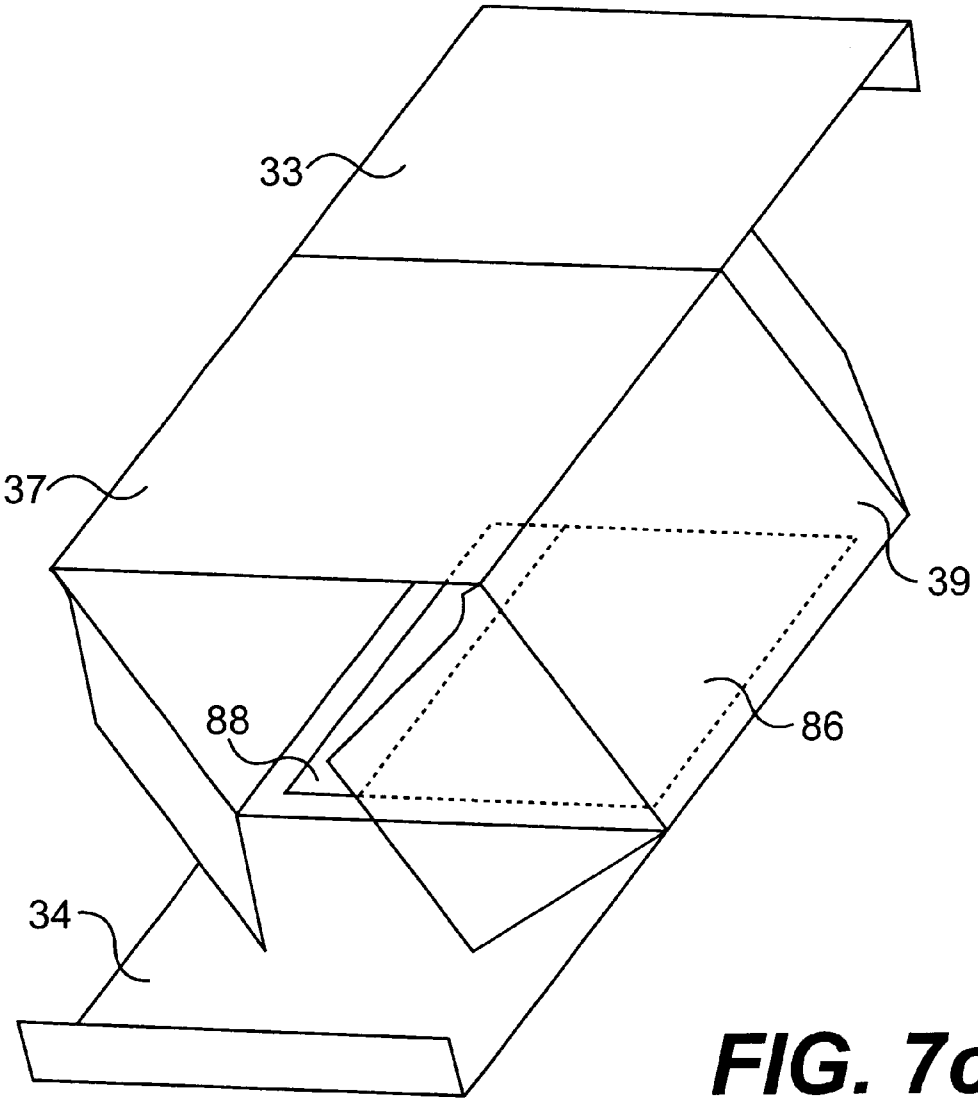
FIG. 7c1

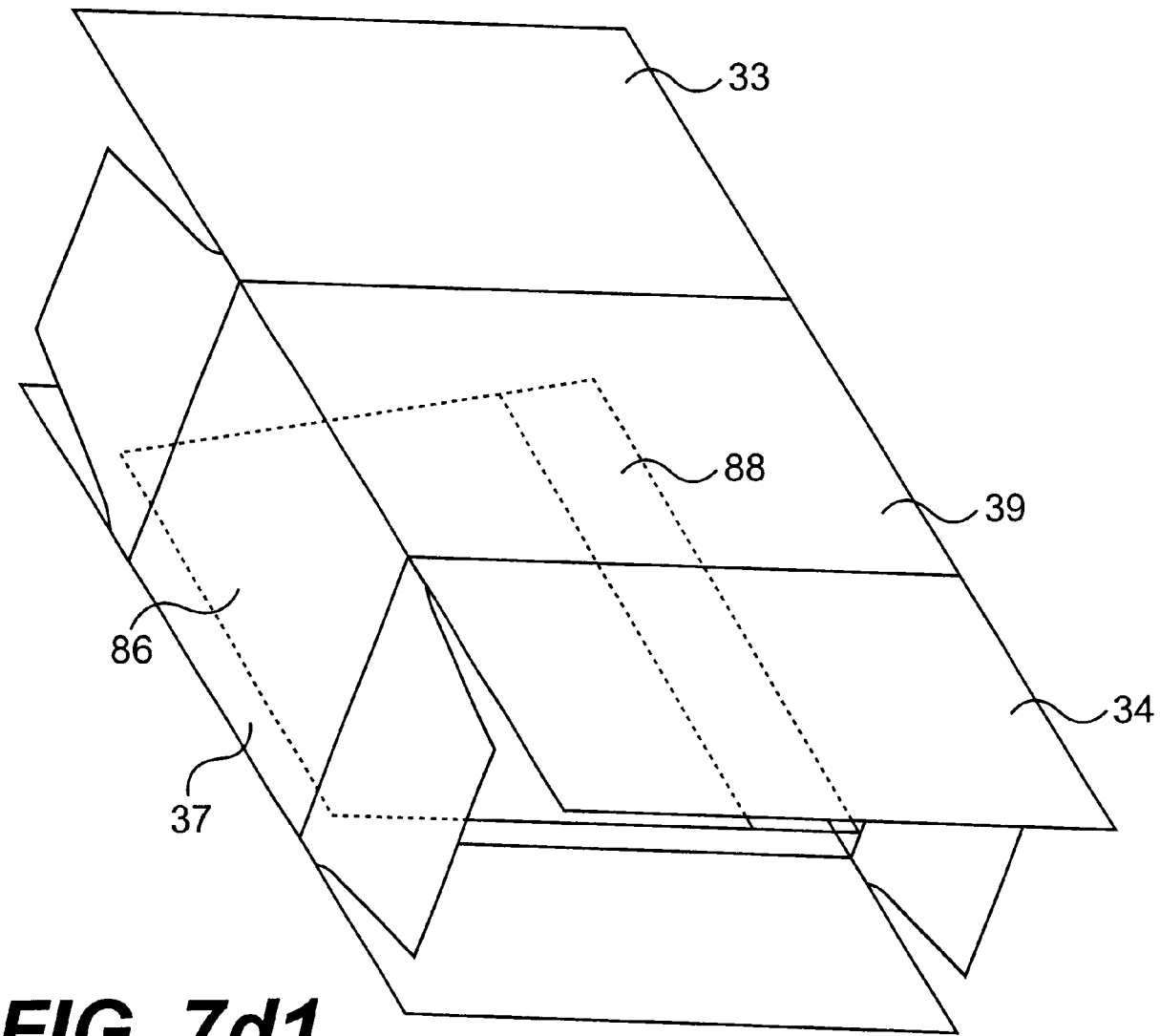
FIG. 7d1

CARTON HAVING A PREFOLDED INTERIOR PAPER LINING AND A METHOD OF PREPARING A CARTON WITH A PREFOLDED INTERIOR PAPER LINING

This application is a division of 08/683,730 filed Jul. 18, 1996.

BACKGROUND OF THE INVENTION

1. Field of the Invention

The present invention relates to a method of preparing a carton, such as a gift box. More particularly, the present invention relates to a method of preparing a carton, such as a gift box, with a prefolded interior paper lining, such as prefolded tissue paper.

2. Description of the Related Art

High end retail stores typically provide their customers with gift boxes. Typically, these boxes are in the form of partially folded carton blanks, which either the store clerk can assemble, or which can be provided to the customer for later assembly at home.

Customers frequently desire an interior paper lining, such as tissue paper, in order to improve the appearance of the gift box. For the sake of efficiency, attempts have been made to prepare carton blanks with prefolded tissue paper already inside, so that once the box is assembled, the tissue paper is already inserted and neatly folded.

These related attempts to prepare boxes with prefolded paper lining have been generally unsuccessful. The tissue paper frequently is torn or crumpled during the preparation process. Another problem is that the creases of the tissue paper generally correspond to the creases of the box blank, which typically results in the paper being crumpled upon assembly of the box. Finally, fixing the paper to the carton blanks creates problems for customers who do not desire tissue paper inside the box, because removal of the paper is difficult and leaves unsightly bits of paper and glue in the box.

SUMMARY OF THE INVENTION

Accordingly, the present invention is directed to a method of preparing a carton with a prefolded interior paper lining, that substantially overcomes one or more of the problems caused by the limitations and disadvantages of related methods. The method of the present invention will provide cartons with a prefolded interior paper lining which, when assembled, will have a neater appearance, a much lower incidence of unusable cartons due to torn and crumpled paper, and consequently a lower overall cost.

Additional advantages of the invention will be set forth in the description which follows, and in part will be apparent from the description, or may be learned by practice of the invention. The advantages of the invention will be realized and attained by the process and apparatus particularly pointed out in the written description and claims, as well as the enclosed drawings.

To achieve these and other advantages, and in accordance with the purposes of the invention, as embodied and broadly described, the invention relates to a method and apparatus of preparing a carton with a prefolded interior paper lining. A box feeder feeds a carton blank in a first direction, the carton blank having a base surface, the base surface having leading and trailing end edges, and first and second side edges, the carton blank base surface further having a first length between the leading and trailing end edges, and a first width between the first and second side edges. Simultaneously, a paper feeding apparatus feeds a paper web under tension. The paper web is folded by a folding apparatus to have at least a base portion, and a first side flap, the first side flap joining the base portion at a first crease, and an opposite edge, the base portion of the paper having a second width between the first crease and opposite edge that is less than the first width of the carton blank base surface. A paper section is cut off of the paper web by a cutting apparatus, the paper section thereby having, in addition to the base portion, the first side flap, and the first crease, leading and trailing edges and a second length between the leading and trailing edges. The paper section is inserted with the carton blank such that the first crease and opposite edge of the base portion of the paper section are spaced a preselected distance inward from the first and second side edges of the carton blank.

Preferably a line of adhesive, preferably a non-permanent, release-type adhesive, is applied to a selected position on the surface of the carton blank. However, in certain cases, the adhesive may be omitted.

When adhesive is used, the paper section is affixed to the carton blank by pressing the base portion of the paper section against the line of adhesive on the carton blank.

In another embodiment, the paper folding apparatus performs an additional step of folding the side flap of the paper into first and second subflaps, joined together by a crease.

The apparatus and method of the invention further may include a step of folding flaps of the carton blank inward over the inserted prefolded paper section.

Variations to the invention are possible. These variations may include varying the dimensions of the carton blank, utilizing a paper web with different dimensions, utilizing multiple paper webs, varying box or carton styles, varying a rate of paper feed, increasing a number of cutting blades in the cutting step, varying types of adhesive application, wetting the paper web, and so on. The paper also may be provided with additional folds, flaps, and subflaps as desired.

BRIEF DESCRIPTION OF THE DRAWINGS

The accompanying drawings, which are incorporated in and constitute a part of the specification, illustrate a preferred embodiment of the invention, and together with the general description given above and the detailed description of the preferred embodiments given below, serve to explain the principles of the invention.

FIGS. 7a1–7d1 are perspective views depicting the cartons of FIGS. 7a–7d, respectively, after assembly of the carton;

DETAILED DESCRIPTION OF THE PREFERRED EMBODIMENTS

Reference will now be made in detail to the present preferred embodiment of the invention, an example of which iris illustrated in the accompanying drawings.

Figure 1:
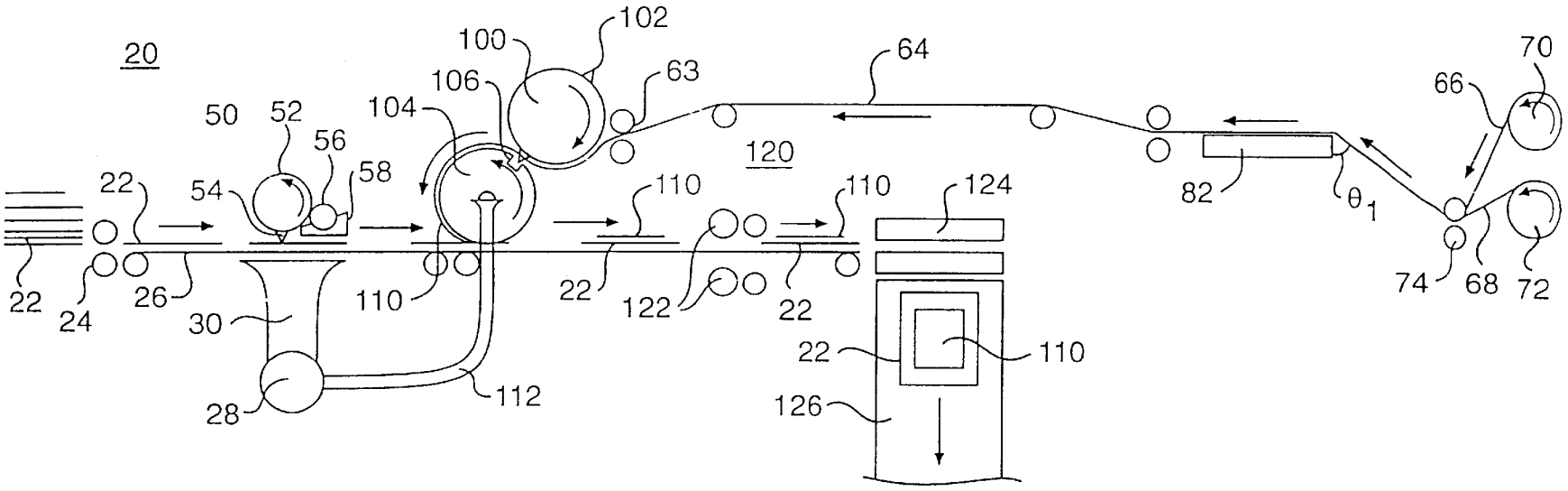
FIG. 1 is a side view depicting schematically an apparatus for performing the method of the present invention.

The exemplary embodiment of an apparatus for performing the method of the present invention is shown in FIG. 1 and is designated generally by reference numeral 20.

In accordance with the invention, a method of preparing a carton with a prefolded interior paper lining comprises a step of feeding a carton blank in a first direction, the carton blank having a base surface, the base surface having leading and trailing end edges, and first and second side edges, the carton blank base surface further having a first length between the leading and trailing end edges, and a first width between the first and second side edges. As broadly embodied herein, and referring to FIG. 1, a plurality of carton blanks 22 are provided, each carton blank 22 being fed between a pair of nip rolls 24 of a standard carton blank feeding apparatus, that is well known in the box-processing art. The nip rolls 24 of the carton blank feeding apparatus feed carton blanks 22 in sequential order onto a conveyor belt 26, with a set spacing between each carton blank 22. The spacing between the carton blanks can be varied depending on the desired feed rate. The feed rate of the blank feeding apparatus can be adjusted by increasing the speed of the nip rolls 24.

Preferably, vacuum is applied to belt 26 to hold carton blanks 22 firmly against the conveyor belt 26. Accordingly, a vacuum pump 28 is provided with a manifold 30 leading to the bottom of belt 26. Belt 26 is provided with a plurality of perforations in order to draw each carton blank 22 firmly against the belt.

Figure 4B:
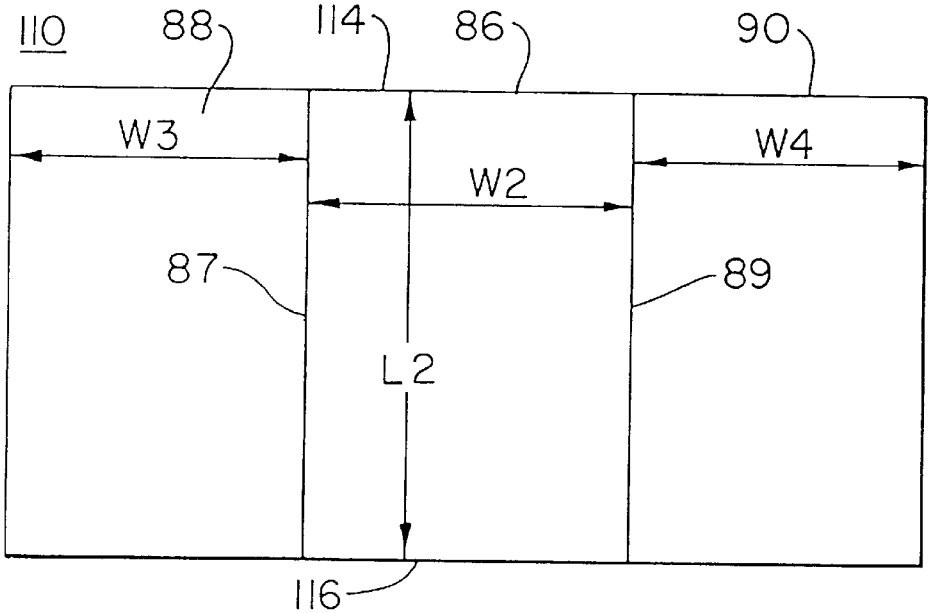
FIGS. 4*a*, 4*b* and 4*c* are top and side views depicting one configuration of a carton blank and a folded paper lining in accordance with the present invention.
Figure 4C:
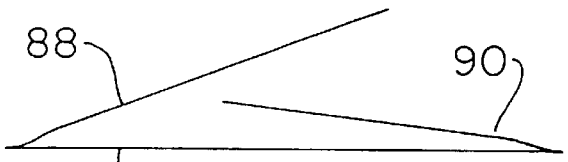
Figure 4A:
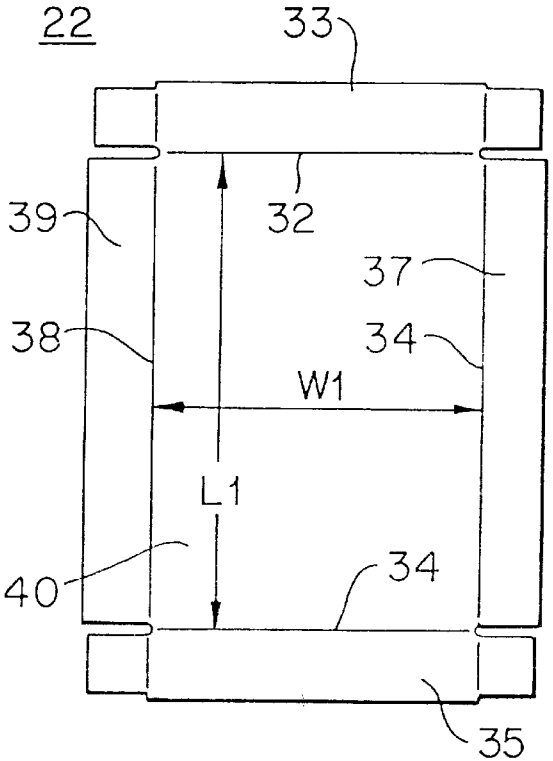
Figure 5B:
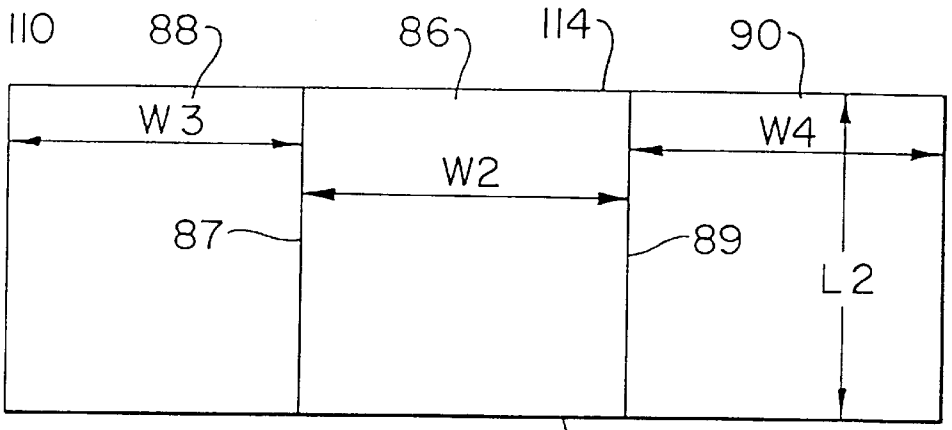
FIGS. 5*a*, 5*b* and 5*c* are top and side views depicting another configuration of a carton blank and a folded paper lining in accordance with the present invention.
Figure 5C:
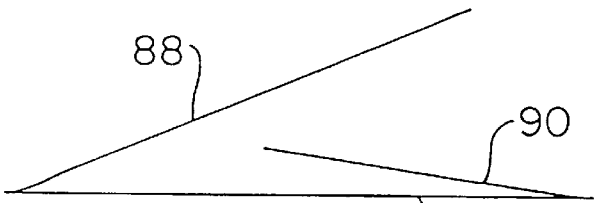
Figure 5A:
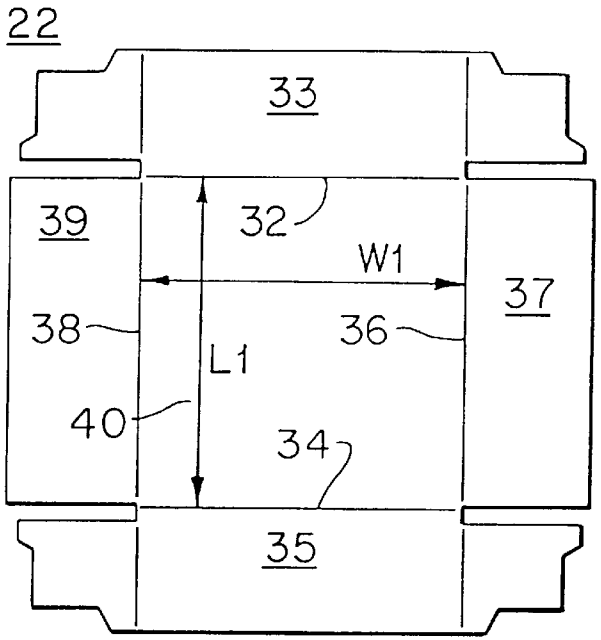
Figure 6B:
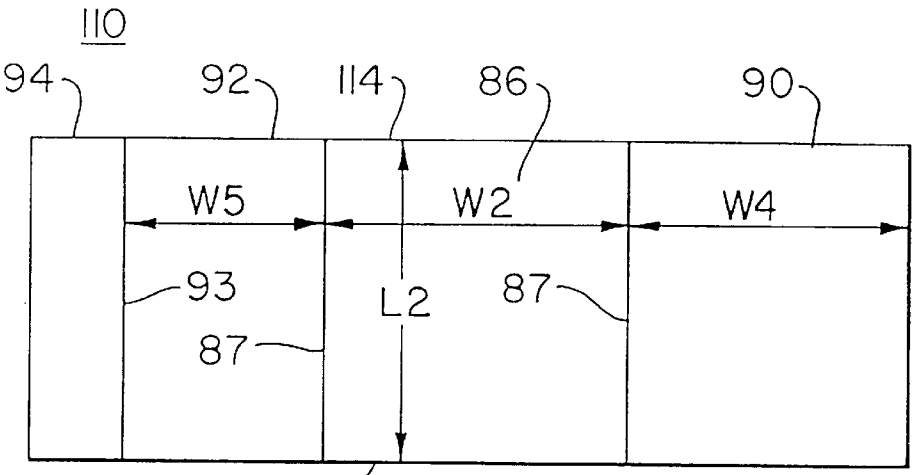
FIGS. 6*a*, 6*b* and 6*c* are top and side views depicting yet another configuration of a carton blank and a folded paper lining in accordance with the present invention.
Figure 6C:
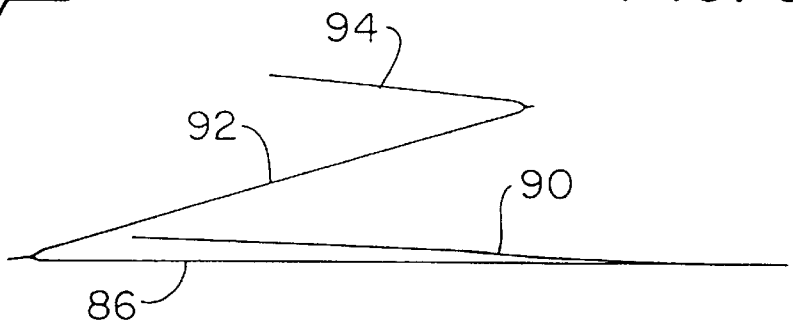
Figure 6A:
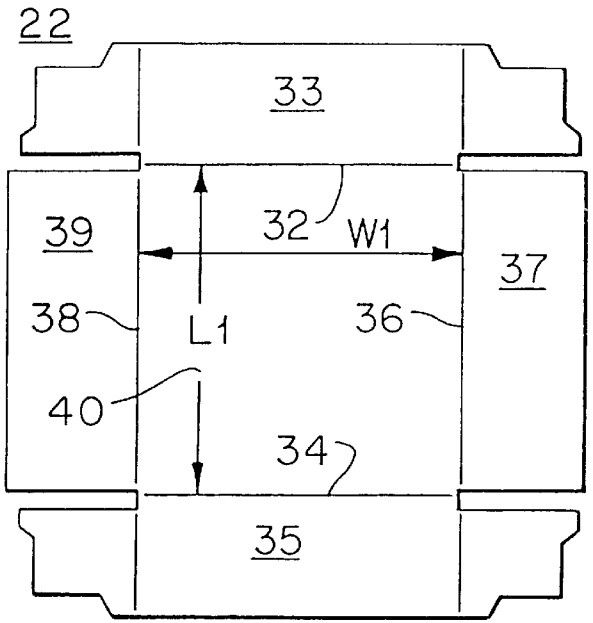

In the embodiment shown in FIGS. 4a, 5a and 6a, each carton blank 22 includes leading and trailing end edges 32, 34, and first and second side edges 36, 38, as well as a base surface 40. The style of carton blank 22 depicted in FIGS. 4a, 5a and 6a, known in the trade as a Biers-style carton, further has a leading flap 33, a trailing flap 34, a first side flap 37, and a second side flap 39. Each carton blank 22 further has a selected first length L1 between each leading and trailing end edge, and a selected first width W1 between each first and second side edge.

For example, FIG. 4a depicts a Biers-style gift box of dimensions 11.5" (L1)×8.5" (W1)×1.625". In other words, the base surface 40 has a length L1 of 11.5"×a width W1 of 8.5", with a 1.625" wide flap at each side and each end. Another Biers-style gift box is depicted in FIGS. 5a and 6a, having the dimensions 7.75"×7.75"×3". In other words, base surface 40 has dimensions 7.75"×7.75", with a 3" wide flap at each side and each end. Other Biers-style gift box sizes can include, for example, 10"×10"×3.5", or 15"×14"×6". However, the invention is not limited to any particular dimension or any style of carton blank.

Figure 7A:
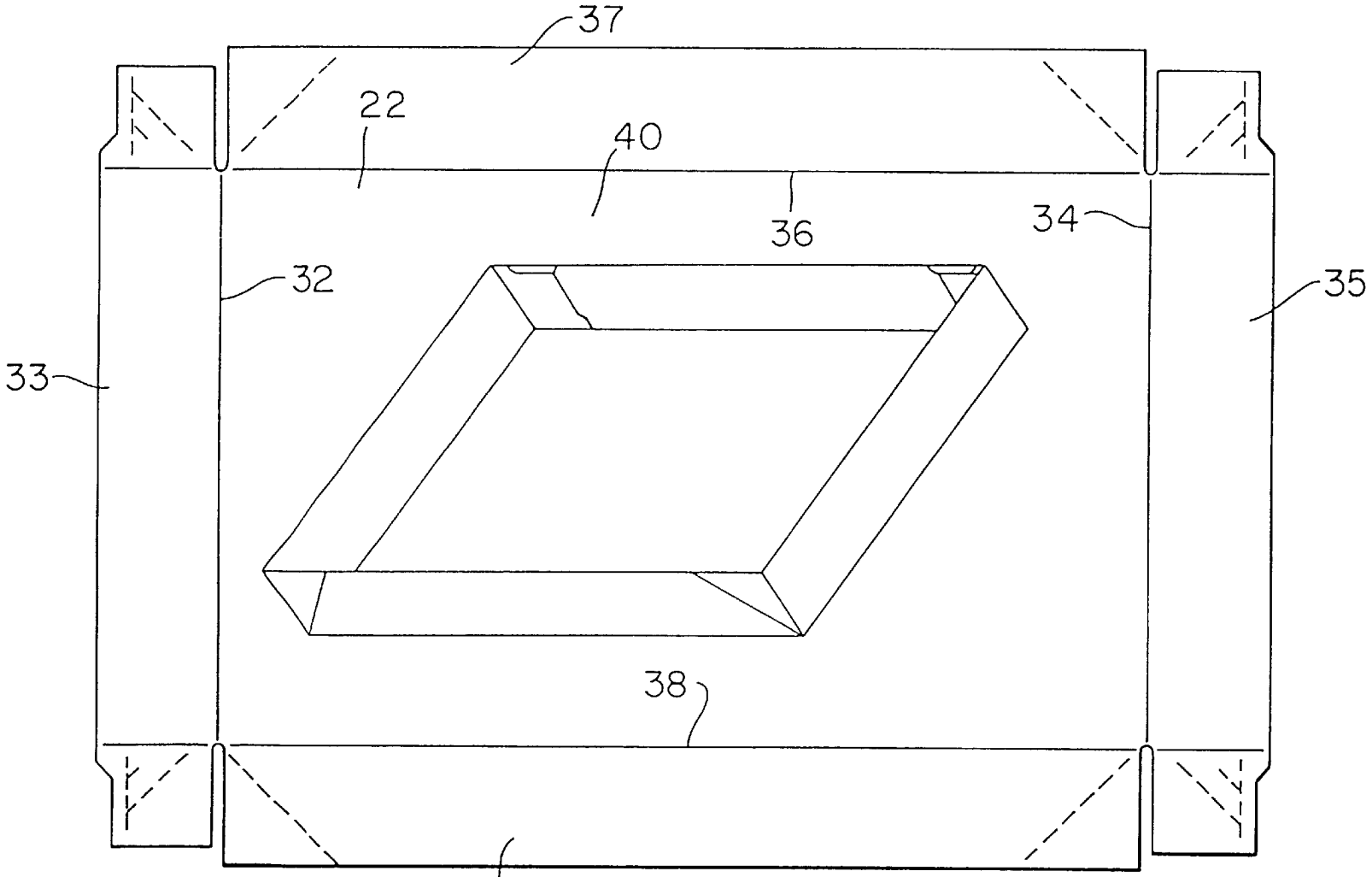
FIGS. 7*a*–7*r* are top views depicting various carton styles, depicting positioning of the paper lining in accordance with the invention.
Figure 7B:
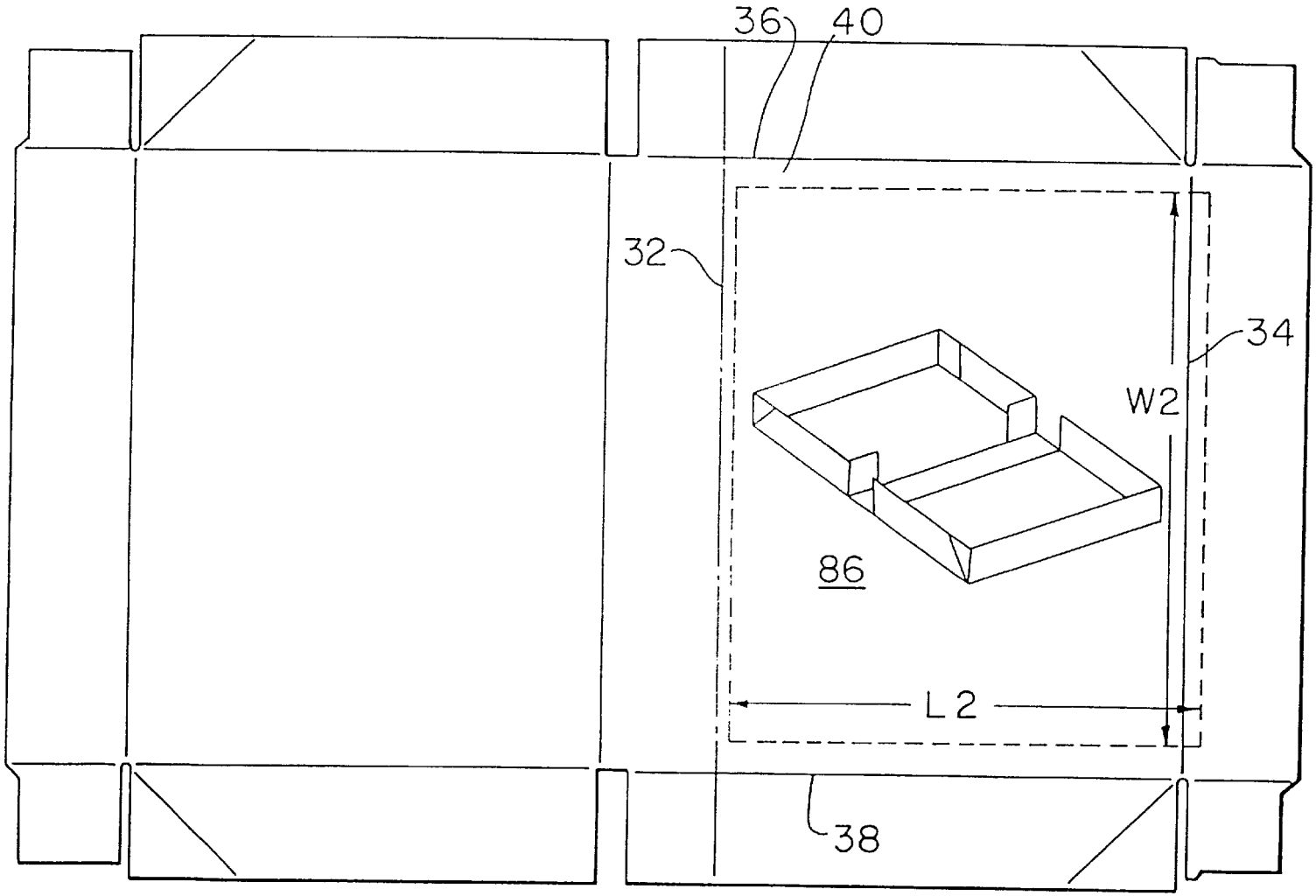
Figure 7C:
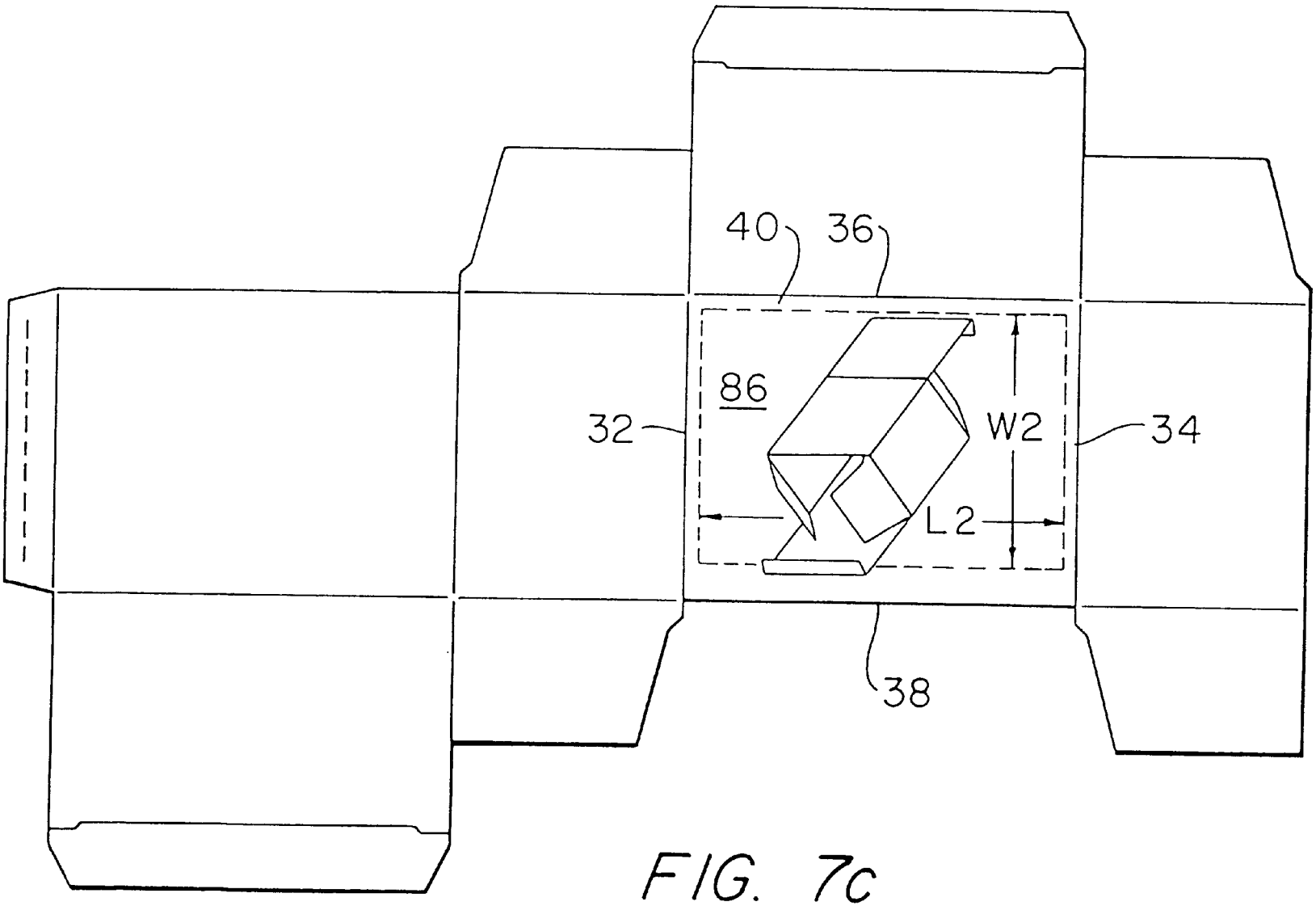
Figure 7D:
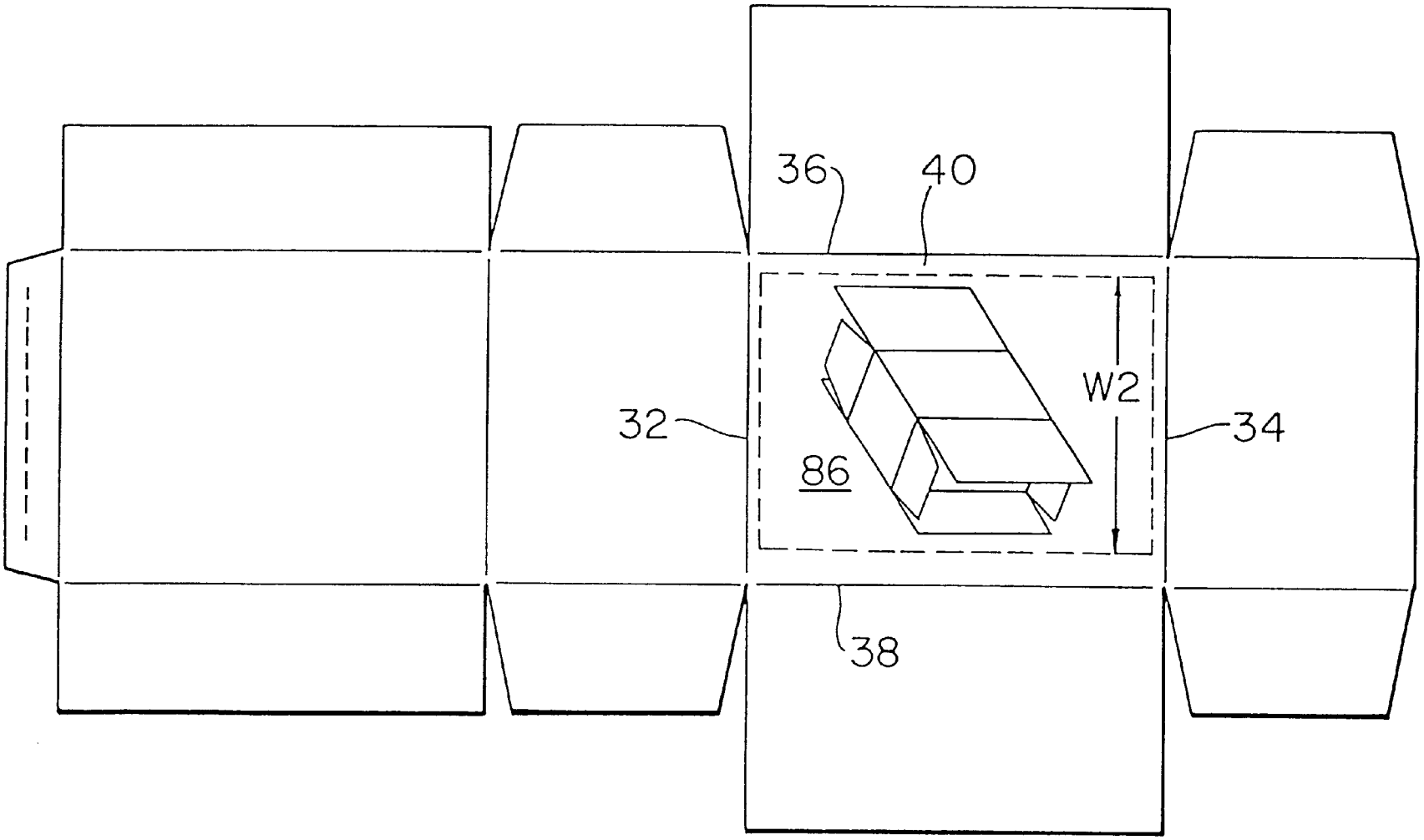
Figure 7E:
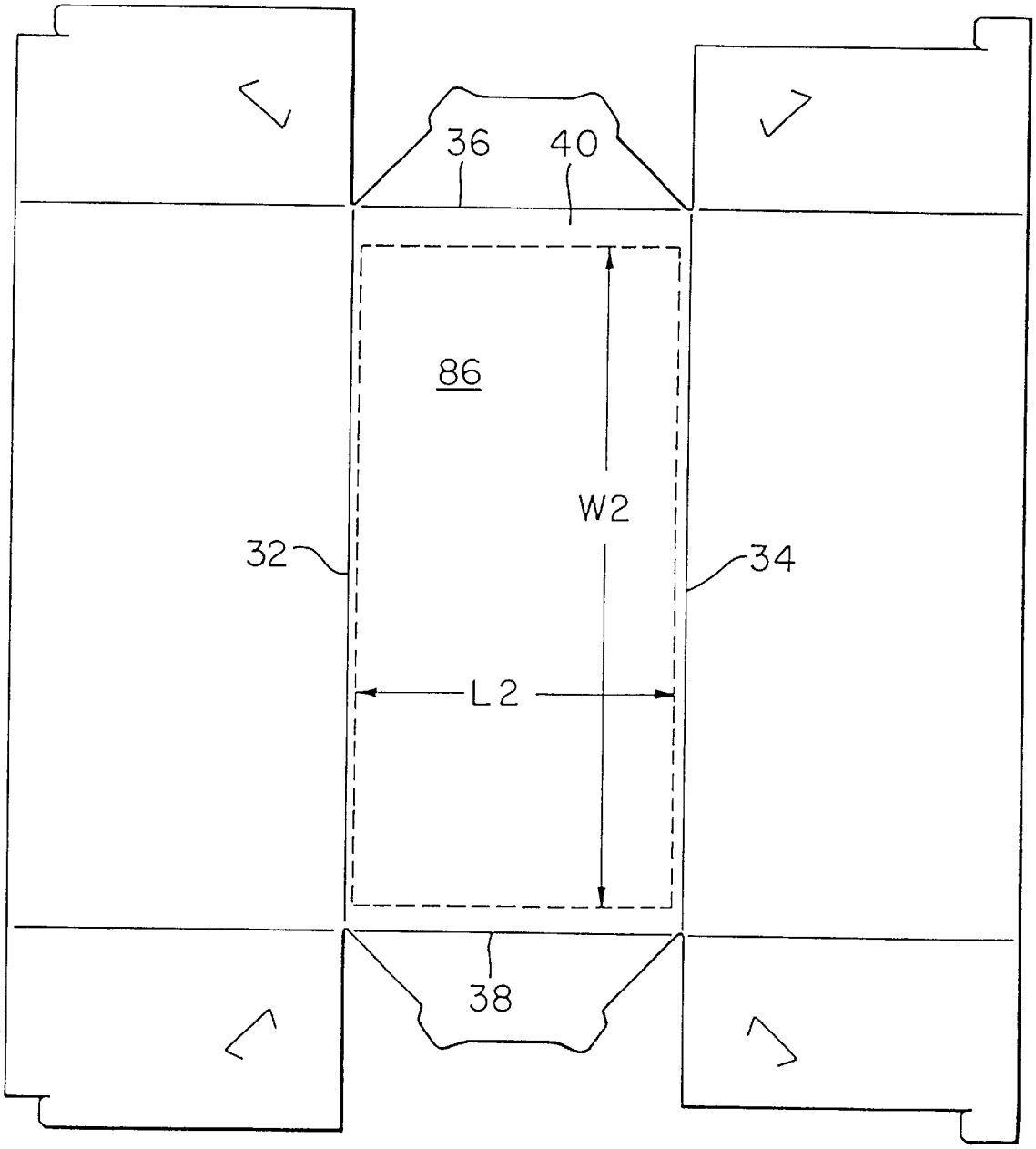
Figure 7F:
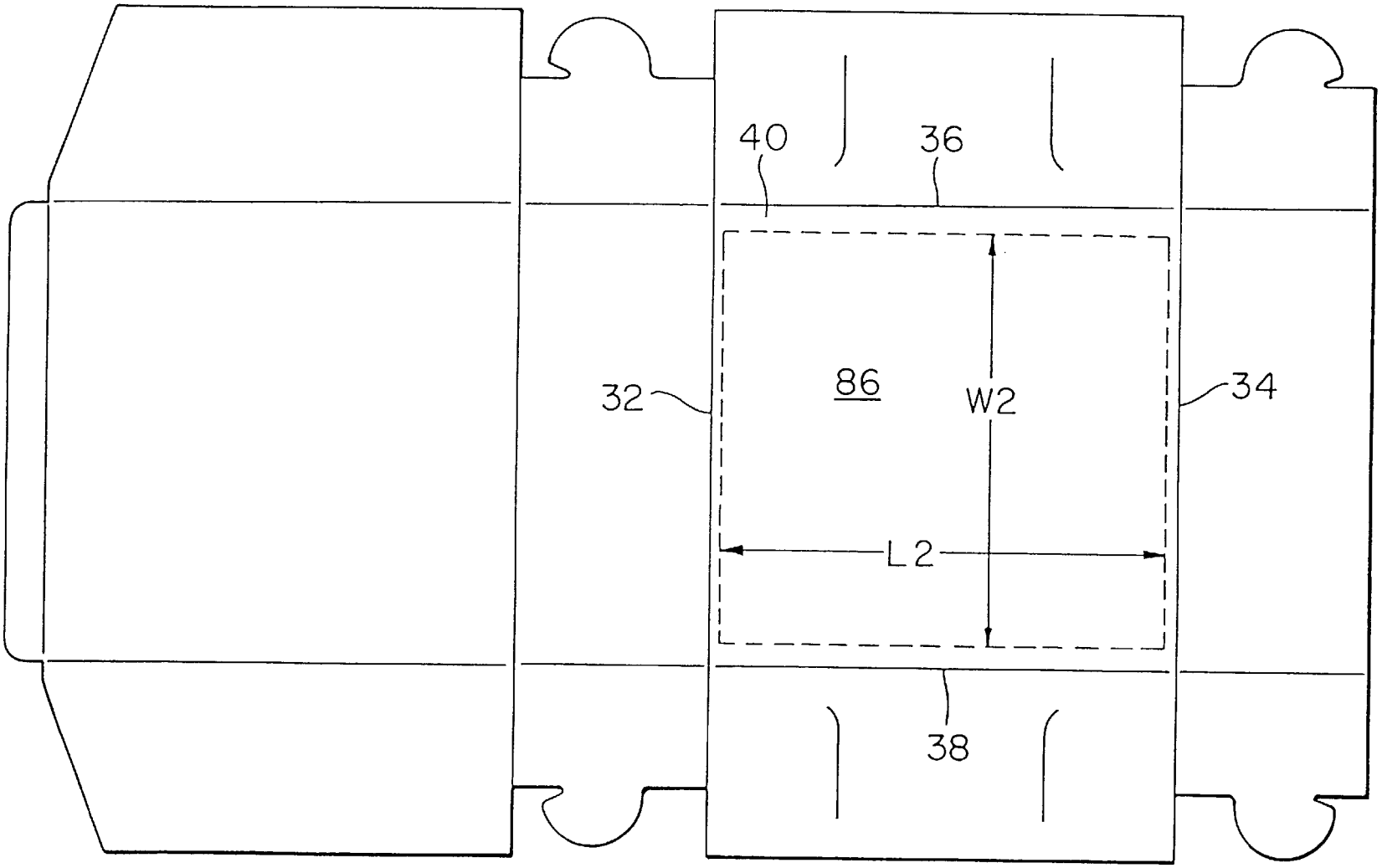
Figure 7G:
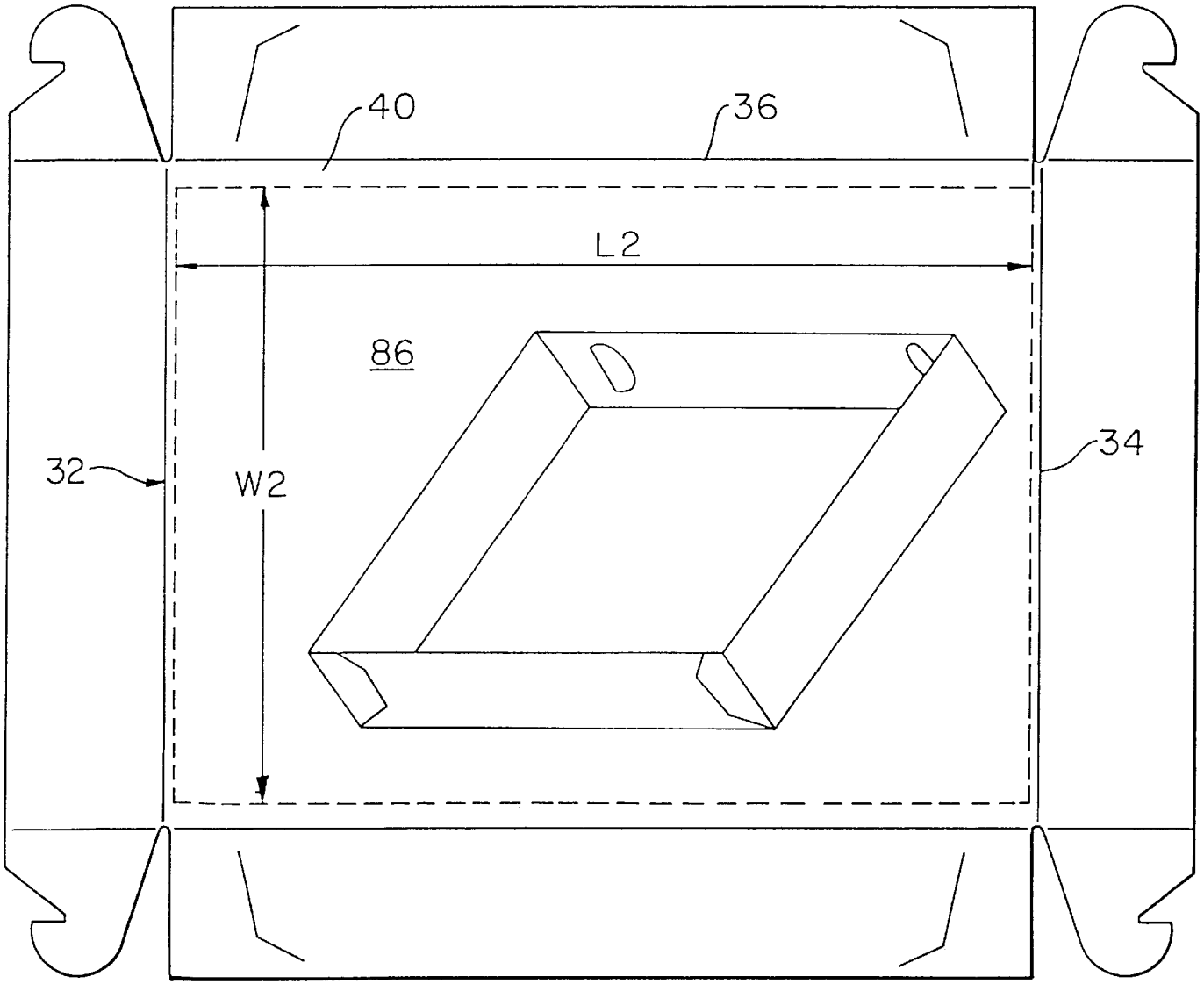
Figure 7H:
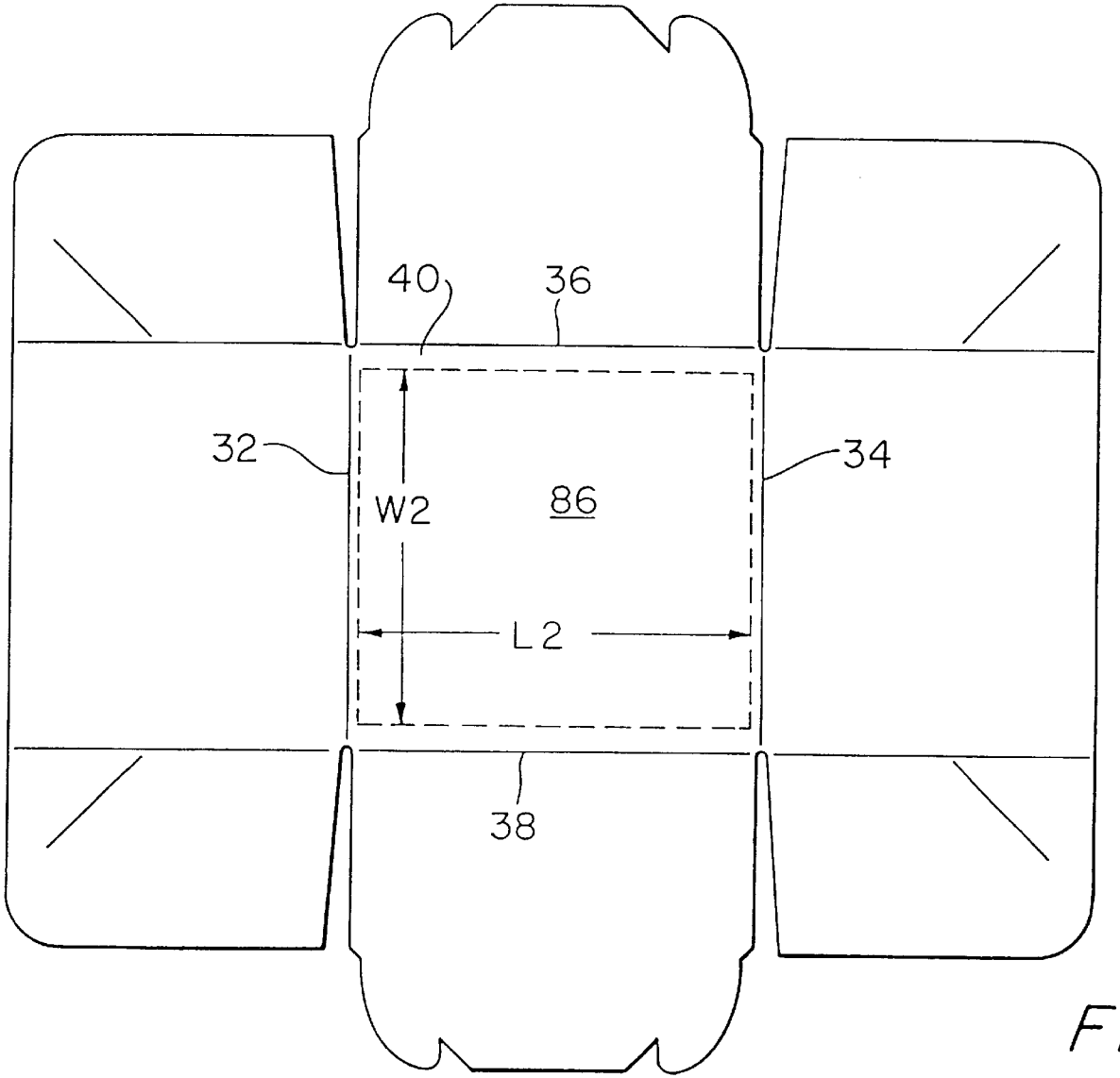
Figure 7I:
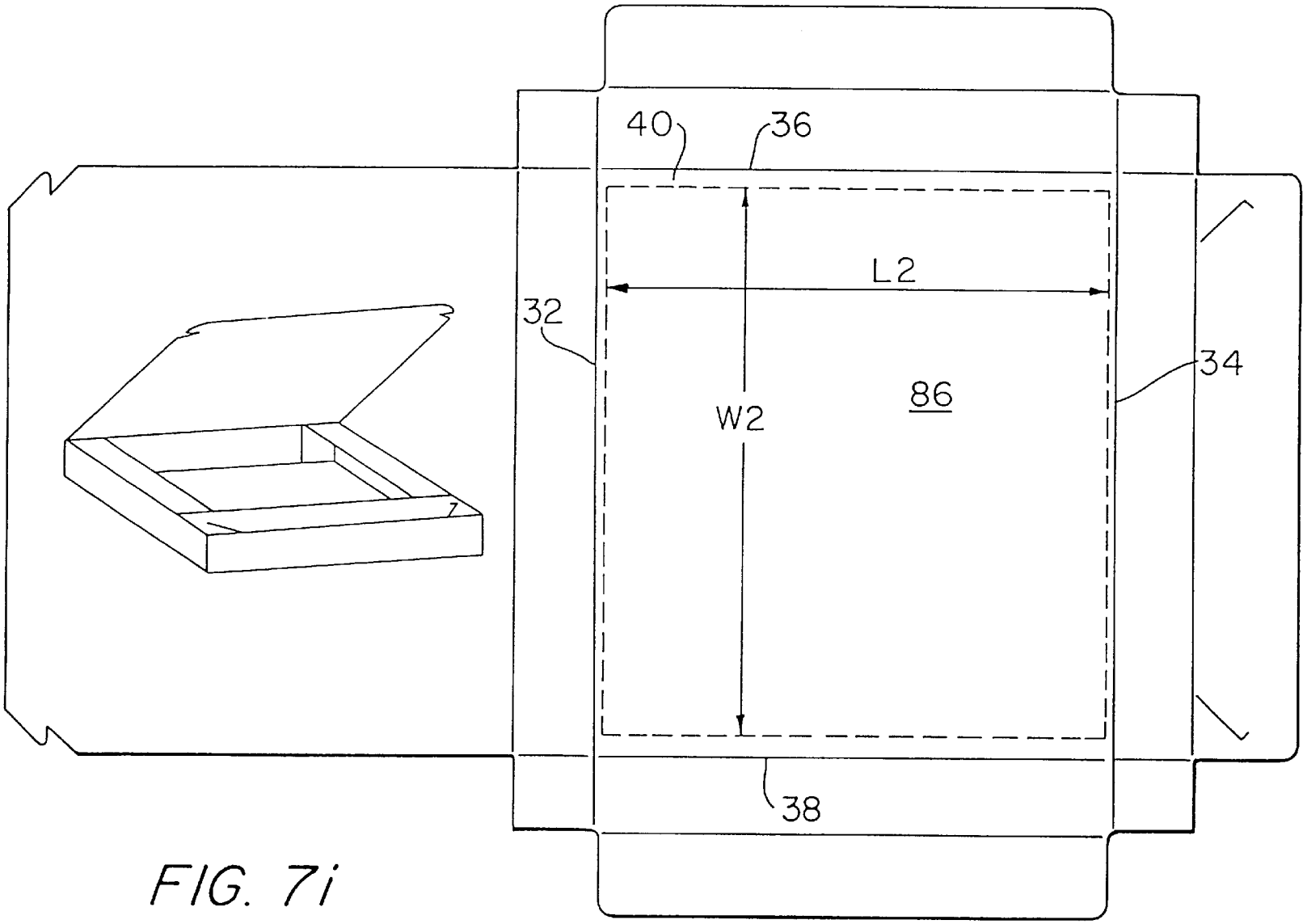
Figure 7J:
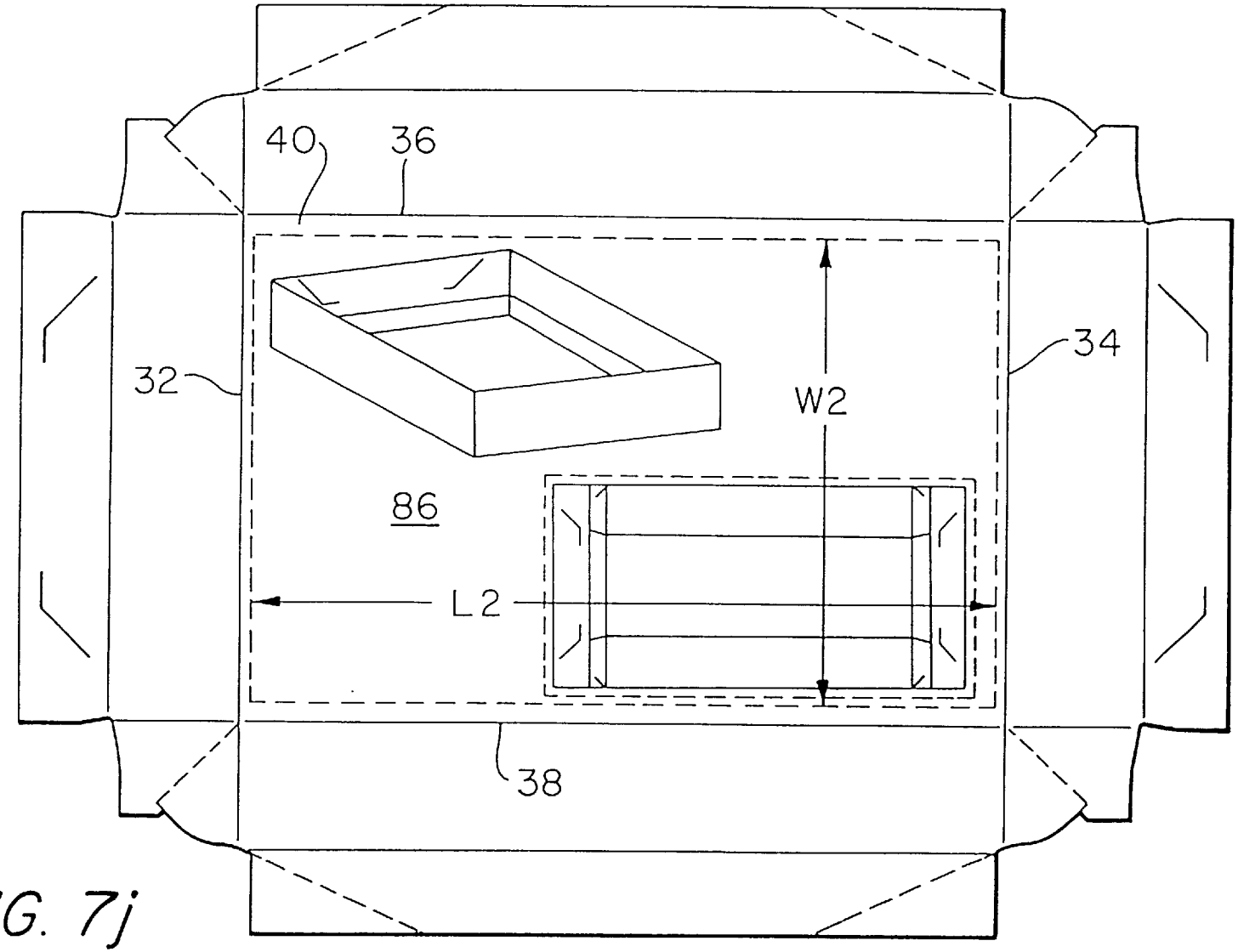
Figure 7K:
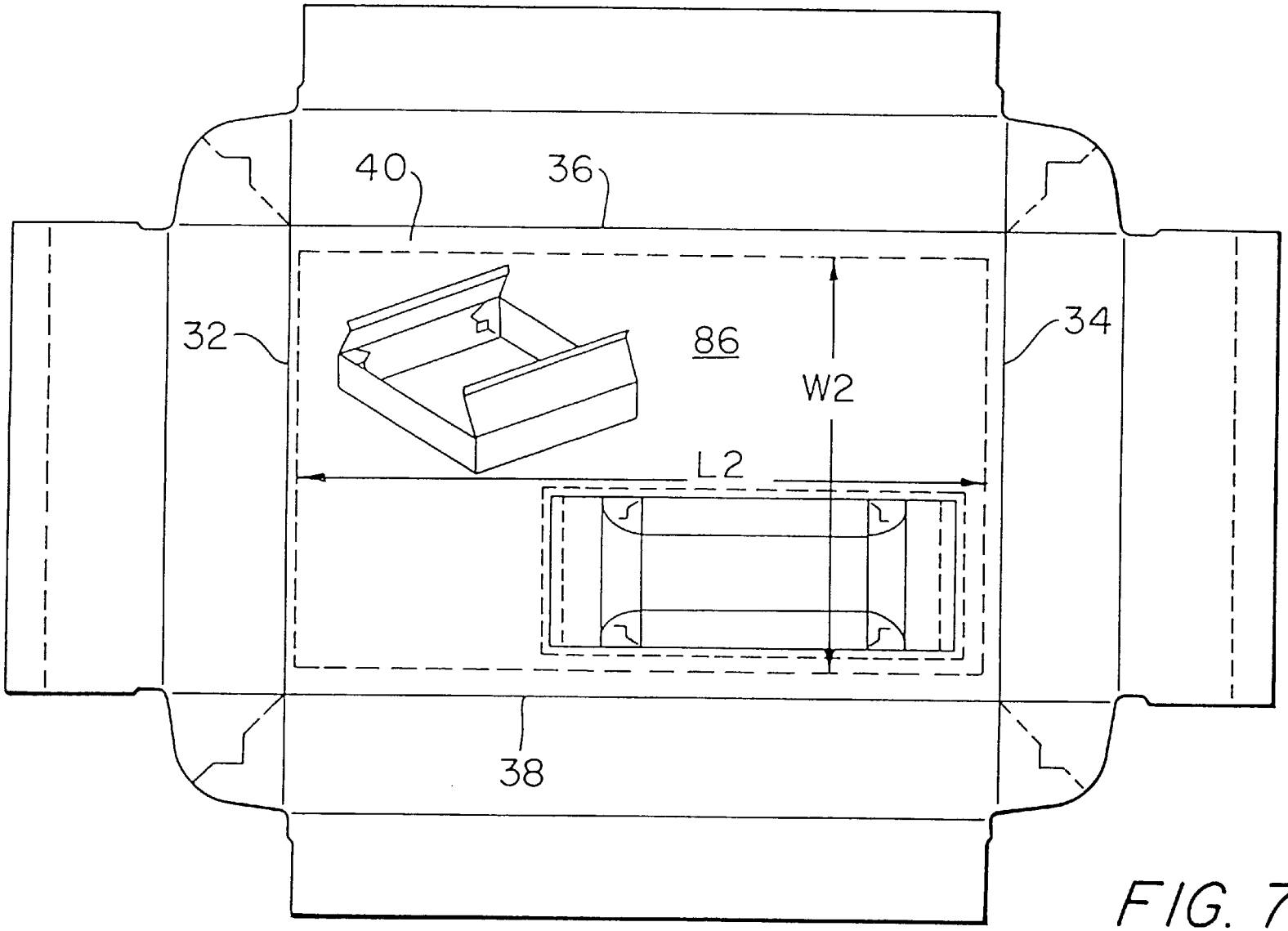
Figure 71:
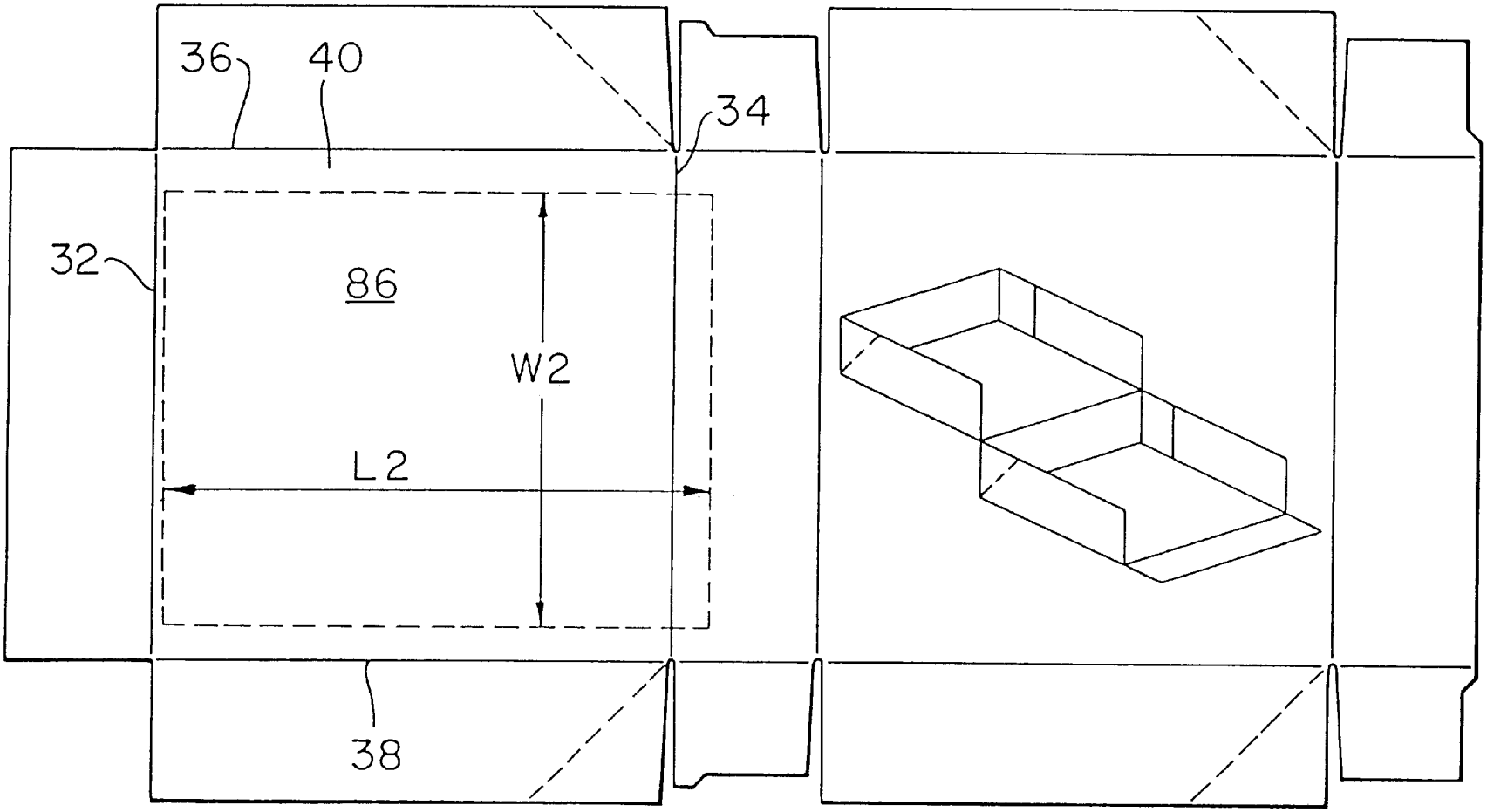
Figure 7M:
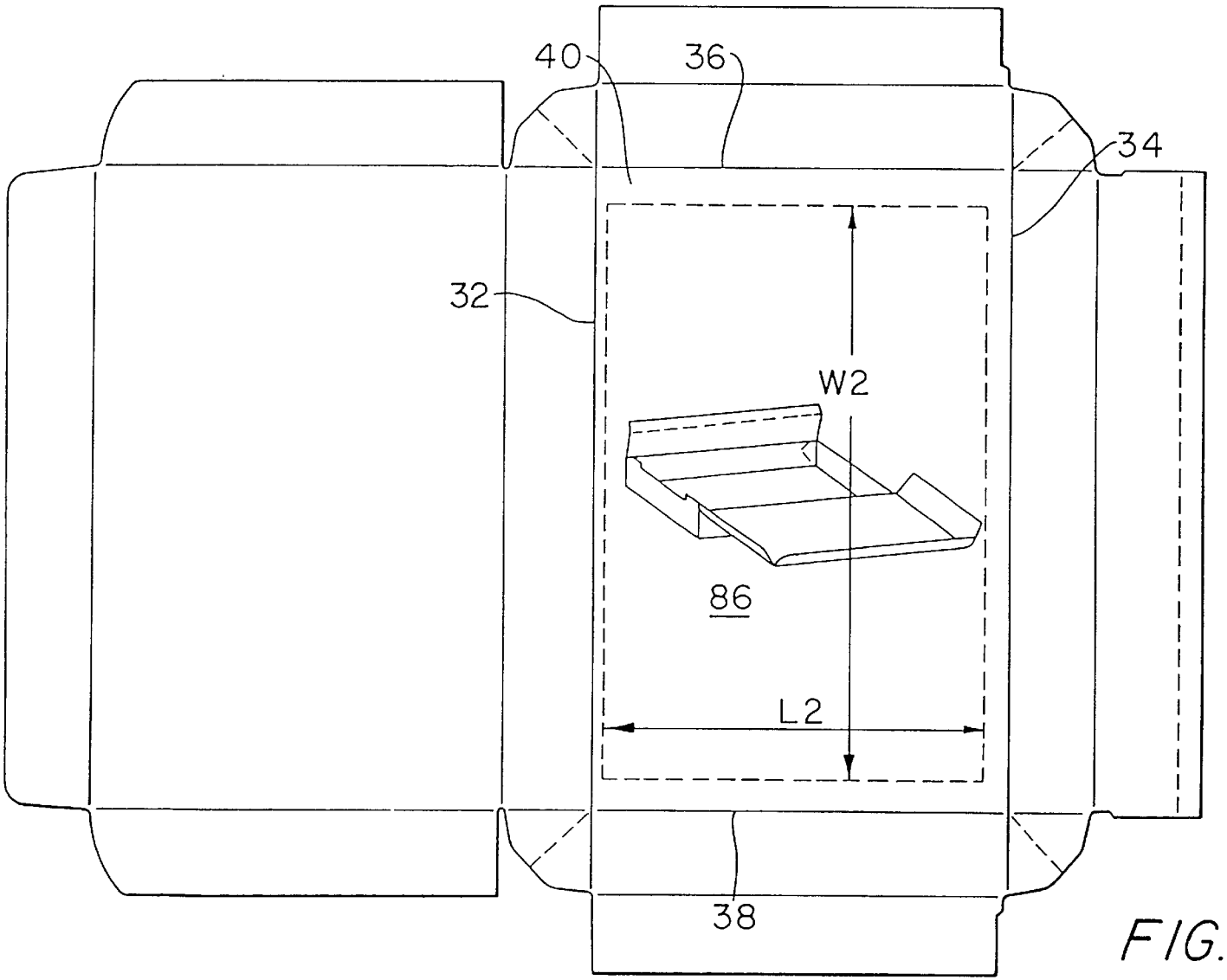
Figure 7N:
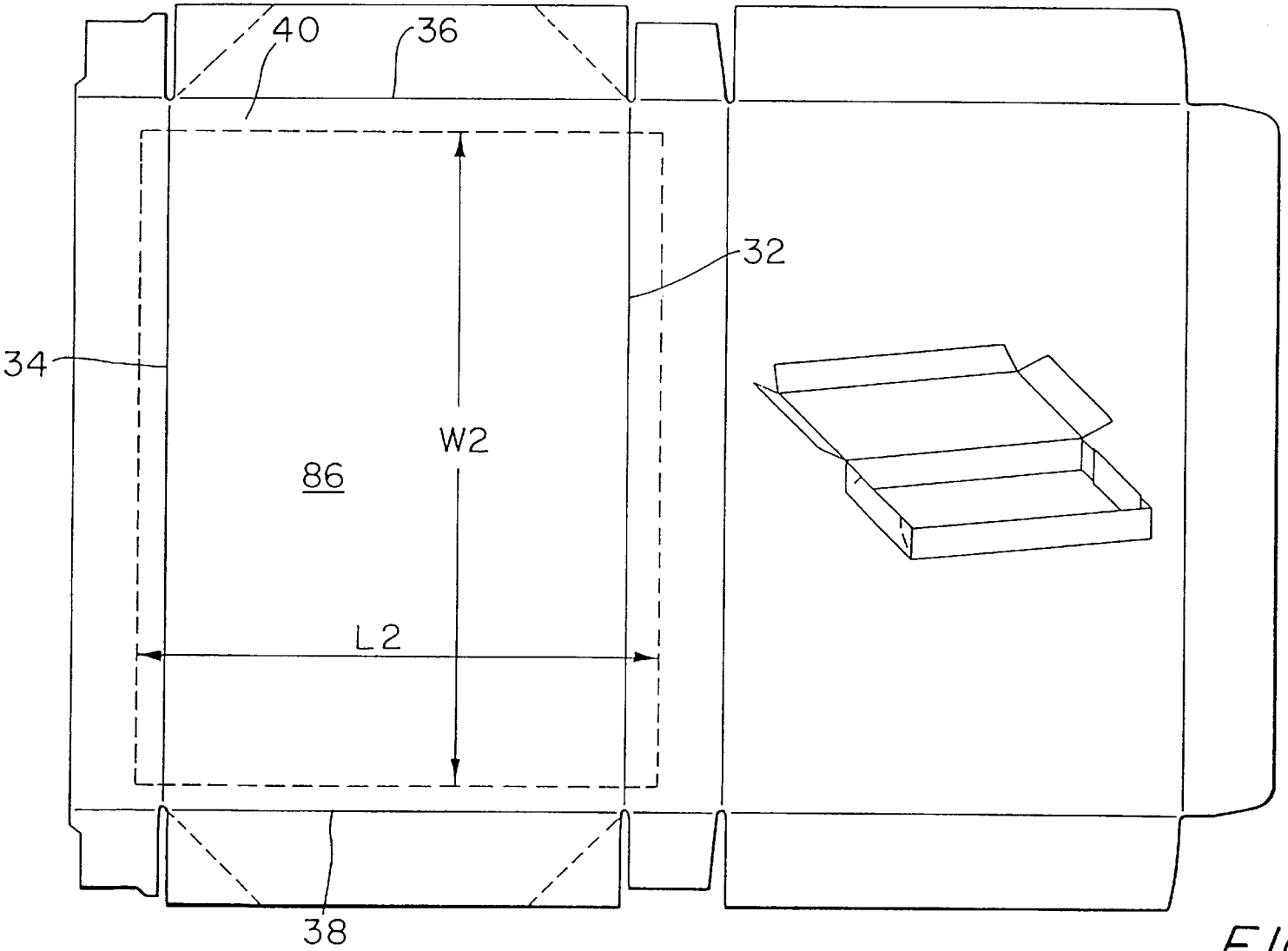
Figure 7O:
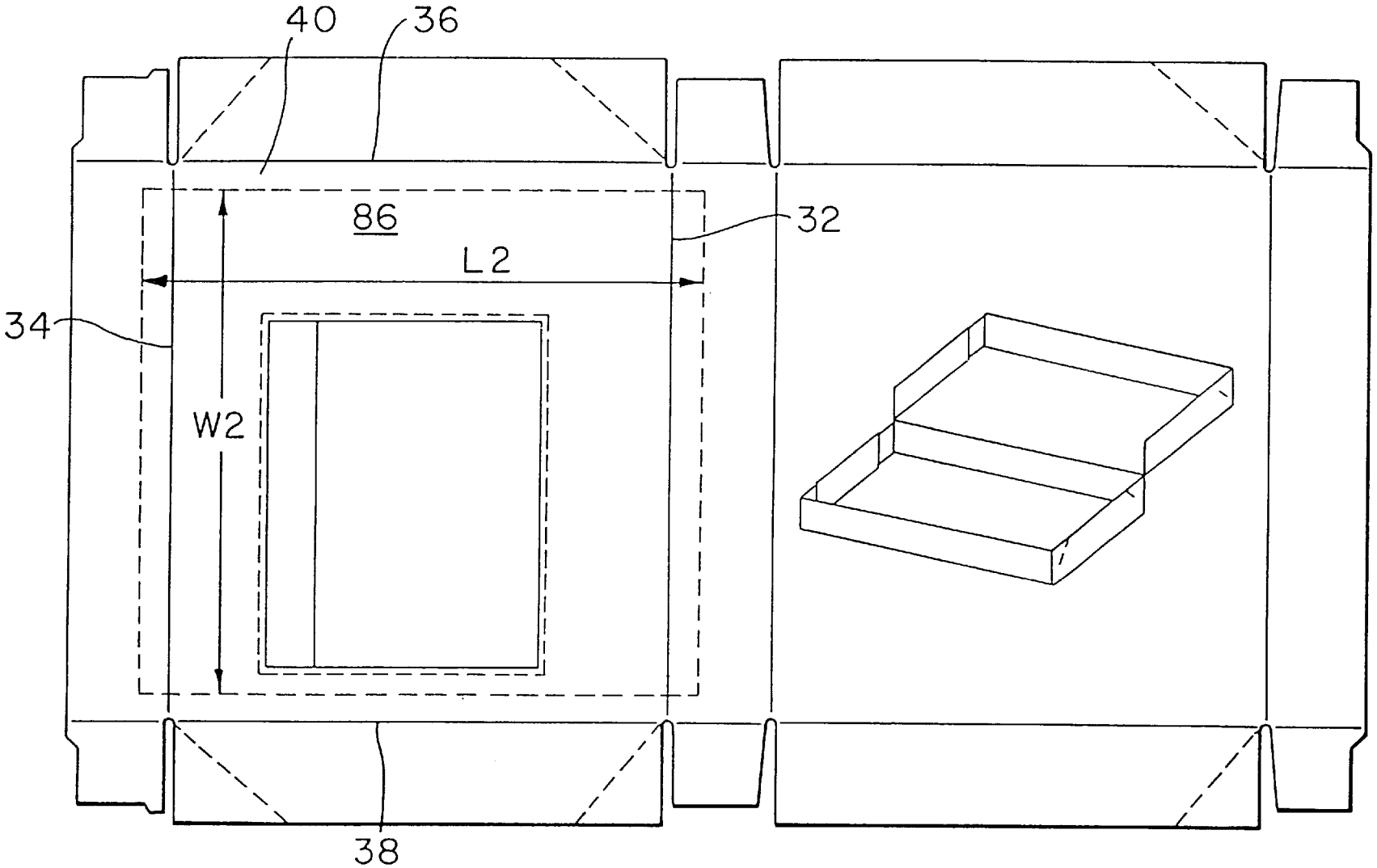
Figure 7P:
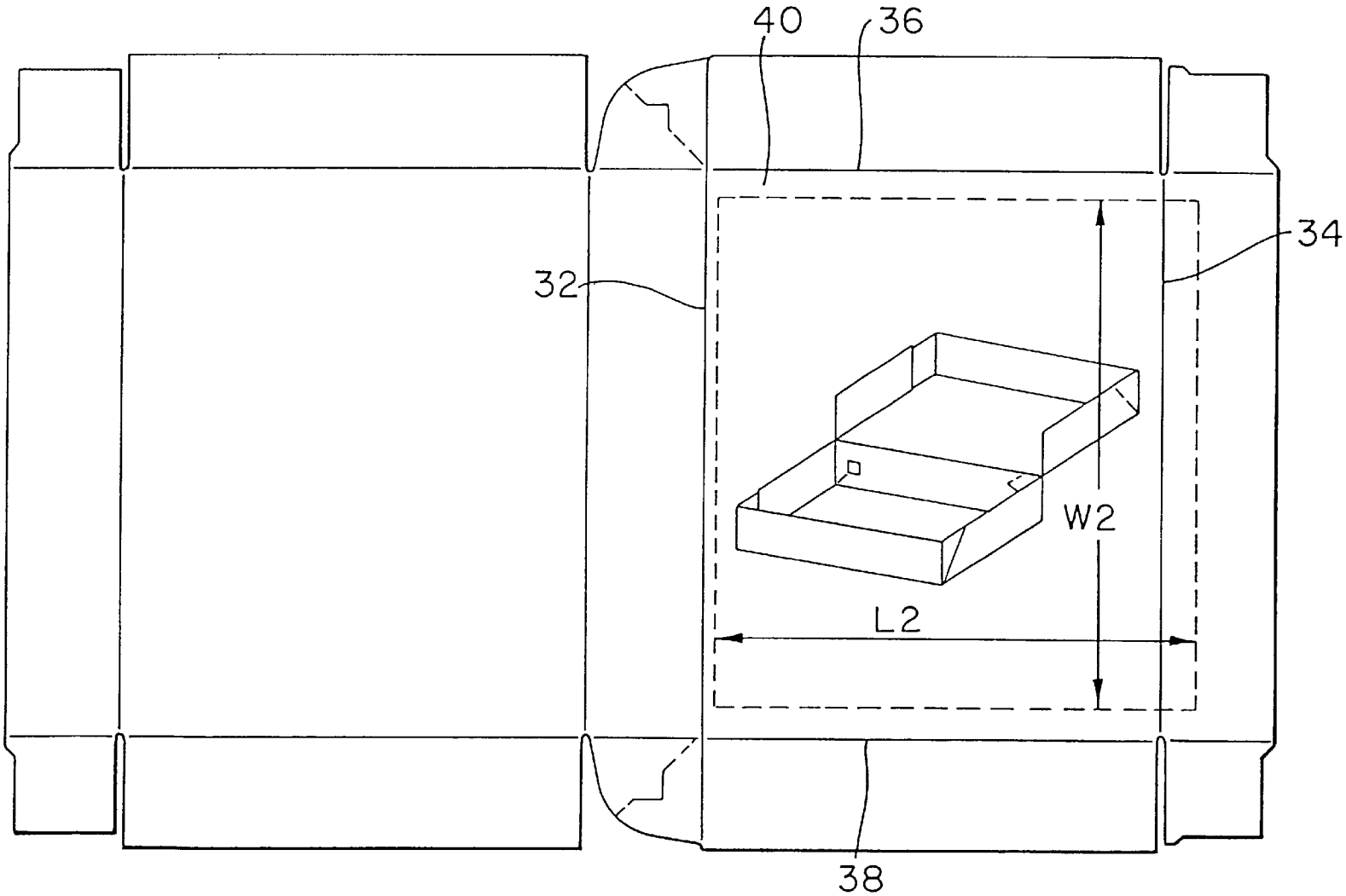
Figure 7Q:
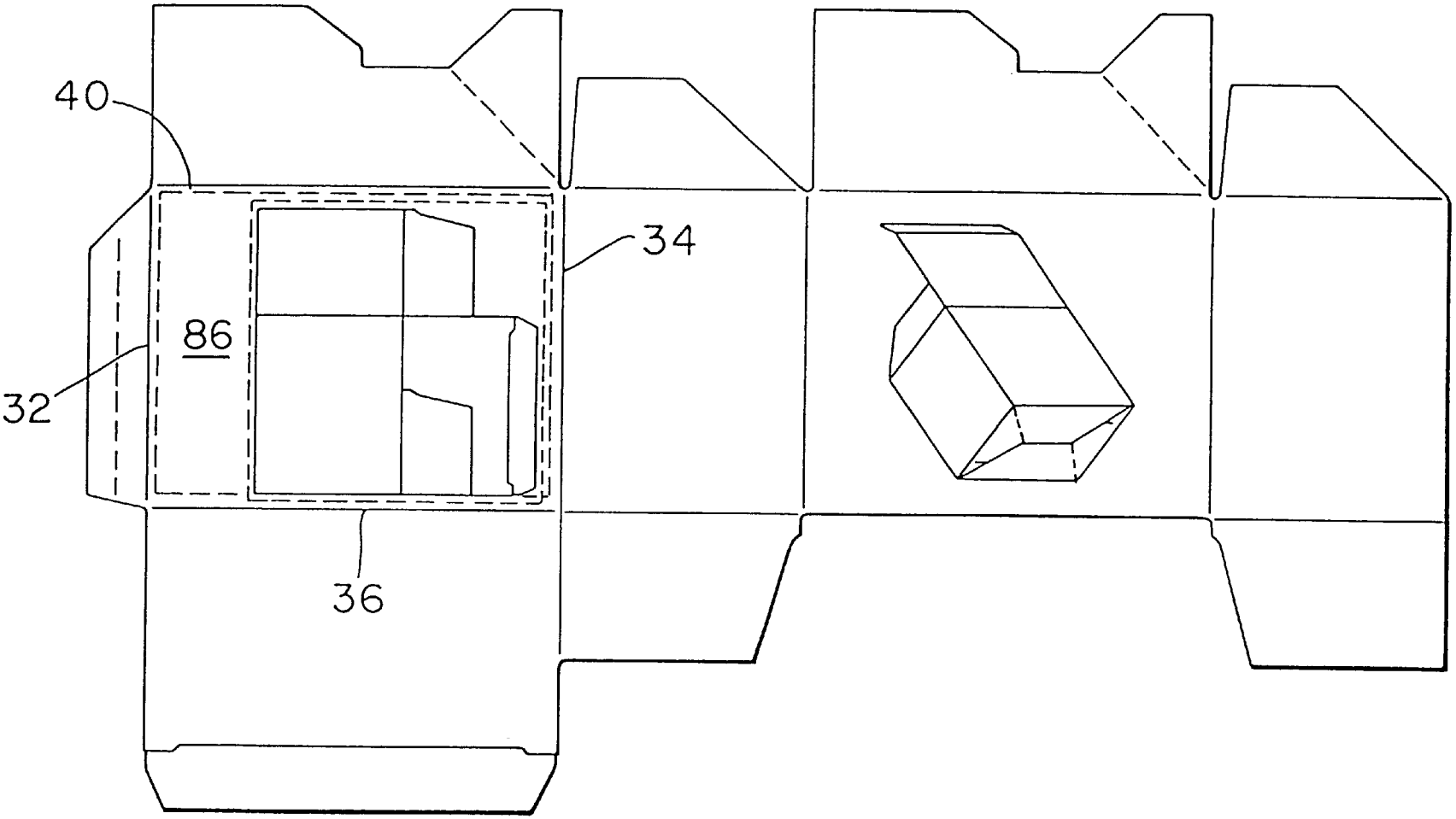
Figure 7R:
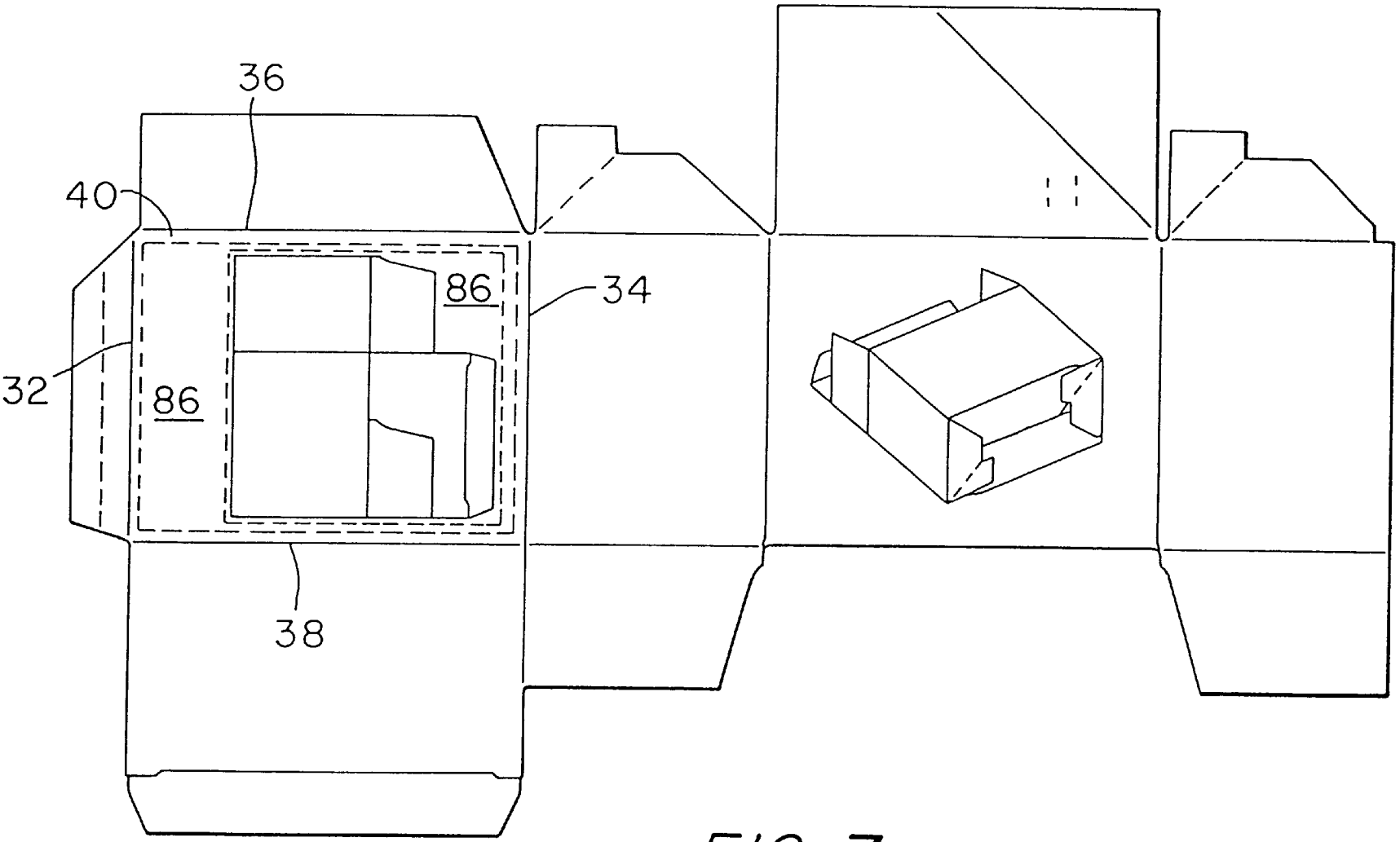

For example, FIGS. 7a–7r depict a number of carton styles which can be used with the present invention. FIG. 7a depicts a bottom section of the Biers-style box shown in FIGS. 4–6. FIGS. 7b–7r, however, depict a wide variety of one-piece and two-piece boxes, that are well known in the box industry. Each style of carton 22 has one common feature, i.e., a base surface 40 having leading and trailing end edges 32, 34, first and second side edges 36, 38, a first length L1 between the leading and trailing end edges, and a first width W1 between the first and second side edges.

Figure 2:
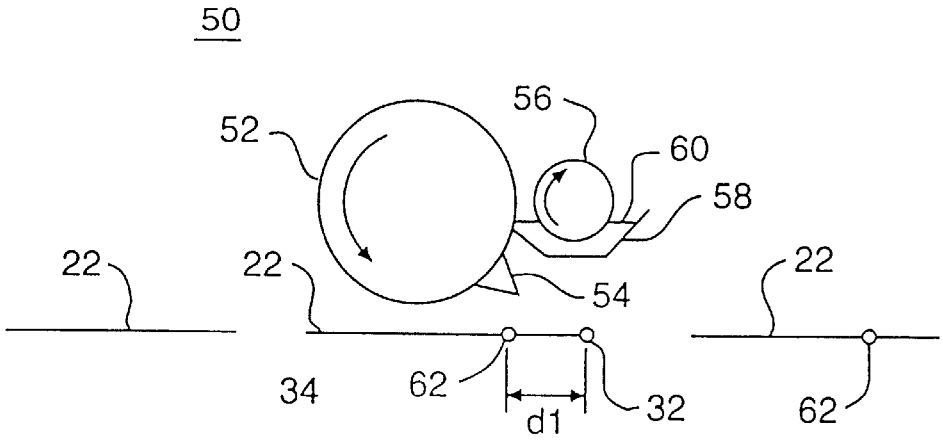
FIG. 2 is a side view depicting schematically a step of applying a line of adhesive to a carton blank in accordance with the present invention.

Preferably the method may include a step of applying a line of adhesive to a selected position on the surface of the carton blank. As broadly embodied herein, and referring to FIGS. 1 and 2, an adhesive applying section 50 includes a rotating drum 52. A wedge 54, made of a resilient material such as rubber or hard plastic, extends lengthwise along the surface of drum 52. An adhesive supply drum 56 rotates alongside drum 52, passing through a reservoir 58 containing liquid adhesive 60. Preferably, adhesive 60 is a non-permanent release type adhesive. Adhesive supply drum 56 picks up adhesive 60 from reservoir 58 and applies it to the apex of wedge 54.

Preferably, rotation of drum 52 is metered to match the rate of feed of carton blanks 22 on feed belt 26. Hence, drum rotation speed can vary as carton feed rate varies. The apex of wedge 54 presses against the surface 40 of each carton blank 22, at a distance d1 inward from one end, preferably the leading end. However, the position of the adhesive is not critical. It is within the scope of the invention to apply the adhesive proximate the trailing end, or anywhere else on the carton surface. This action deposits a thin line of adhesive 62 on the surface 40 of carton blank 22.

The adhesive applying step, when utilized, may be varied. For example, use of a wedge 54 with one or more separations along its length may be desired in order to apply a broken line 62 of adhesive on the carton blank surface. Wedge 54 also can be arranged to define a straight line, a pattern, a circle, or any other geometric shape or free forming per customer requirements. The position of adhesive line 62 on the surface of a respective carton blank also may be varied. Furthermore, use of different adhesives having different strengths is contemplated. Additional wedges 54 may also be mounted on drum 52 to provide additional lines of adhesive 62.

In certain cases, no adhesive is desired. Hence, in an alternative embodiment, the adhesive applying step may be omitted altogether.

In accordance with the invention, a step is provided of feeding a paper web under tension. As broadly embodied herein, and referring to FIG. 1, nip rolls 62 rotate and draw a paper web 64 in a second direction under tension. As shown in FIG. 1, the direction of travel of paper web 64 is a second direction that is opposite to the direction in which carton blanks 22 are fed. However, the invention is not limited to this direction of travel. The paper web can be fed in the same direction as the carton blanks, at a 90° angle to the carton blanks, or in any other direction relative to the carton blanks. The rate of feed of the paper web 64 can be varied by increasing or decreasing the speed of rotation of nip rolls 62.

As broadly embodied in FIG. 1, paper web 64 comprises a combination of two separate paper webs 66, 68, which are fed from paper rolls 70, 72, respectively, to nip rolls 74. Paper rolls 70, 72 rotate freely, with the paper web being pulled by the rotation of nip rolls 62. This type of double sheet paper web is preferable when a two colored paper lining is desired e.g., a combination of white and red. However, the invention is not limited to a double-sheet paper web. A single sheet web, or any multiple sheet web is within the scope of the invention, simply by adding or deleting paper rolls.

In order to help prevent tearing and crumpling of the paper web during the application process, it has been found preferable to wet the paper slightly. Wetting makes the paper slightly heavier and discourages the ends of the web from curling or "flying away" during the folding, cutting and gluing steps described below.

In accordance with the invention, a step is provided of folding the paper web. The folded web can have a variety of configurations, as discussed below.

Figure 3:
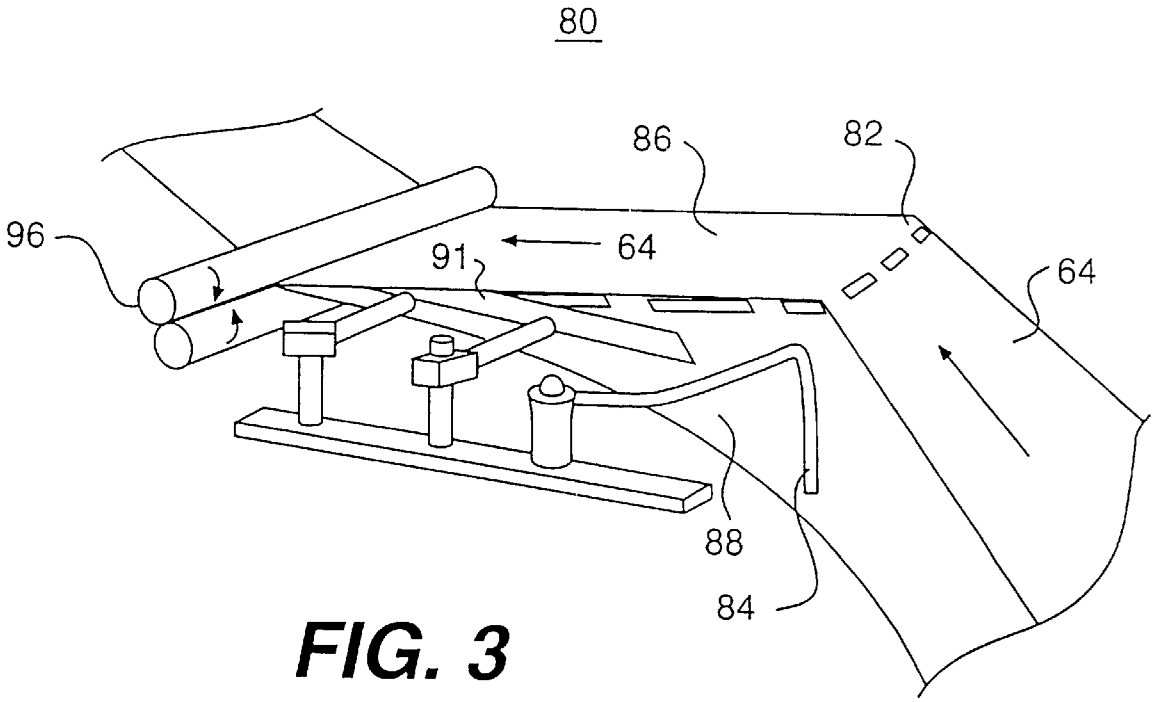
FIG. 3 is a perspective view depicting a step of feeding a paper web in accordance with the present invention.

As broadly embodied herein, and referring to FIGS. 1 and 3, a folding station 80 includes a horizontal platform 82, over which paper web 64 is draped and pulled. Paper web 64 defines an angle $\theta_1$ with horizontal platform 82, which preferably is approximately 47°. After much experimentation, it has been found that this angle $\theta_1$ provides optimum tension to the paper web during the feeding and folding stages to prevent tearing the paper.

As broadly embodied in FIG. 3, a folding bar 84 is provided to fold web 64, thereby creating a base portion 86 and a side flap 88. FIG. 3 only depicts one side of paper folding station 80. If desired, a similar folding bar 84 (not shown in FIG. 3) can be provided on the opposite side, thereby creating a second side flap 90 (not shown in FIG. 3).

The interaction of folding bar 84 and horizontal platform 82 creates a web 64 having a fold. FIGS. 4*b* and 4*c* depict one possible configuration of paper fold. FIGS. 5*b* and 5*c* depict the same configuration of paper fold having different dimensions. The folded web 64 in these drawings includes a base portion 86, a first side flap 88, and a second side flap 90. First side flap 88 is joined to base portion 86 via a first crease 87. Second side flap 90 is joined to base portion 86 via a second crease 89.

The folded paper web has a second width W2 between creases 87 and 89 that is less than the first width W1 between the side edges 36 and 38 of the base surface of carton blank 22. The rationale for these dimensions will be explained below.

One alternative paper fold configuration is depicted in FIGS. 6*b* and 6*c*. In this configuration, another fold is performed on one of the side creases by providing an additional folding apparatus to folding station 80, thereby creating two subflaps joined together by a third crease. As broadly embodied in FIG. 3, a cam or "guide plough" 91 can be optionally provided beneath horizontal surface 82 to crease the side of flap 88. Cam 91 creates a third crease 93, dividing flap 88 into a pair of subflaps 92 and 94, as broadly shown in FIGS. 6*b* and 6*c*.

It is further possible to fold the other flap 90 into a pair of subflaps joined by a fourth crease, by providing another cam or "guide plough" on the opposite side of horizontal surface 82.

The invention is not limited to any particular paper fold. It is not even required that the paper have two flaps. In some cases, only a single flap will be required, defining the base portion of the paper by a first crease and an opposite edge.

Alternatively, additional creases and flaps may be provided in the paper web, in order to create any desired configuration to the folded paper lining, by adding additional folding structure to folding station 80. The invention therefore is not limited to the number of folds that can be provided in the paper web. The number of folds, flaps and subflaps will be a function of customer preference.

Figure 8A:
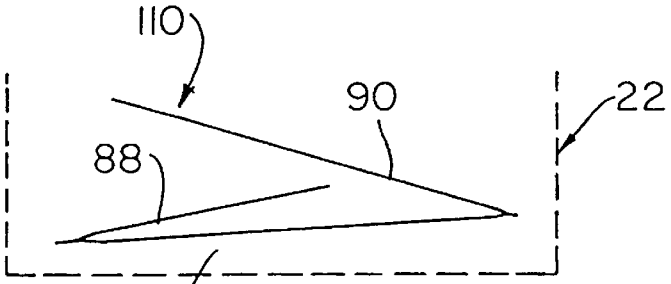
FIGS. 8a–8p are side views depicting a number of configurations of folded paper linings in accordance with the present invention.
Figure 8B:
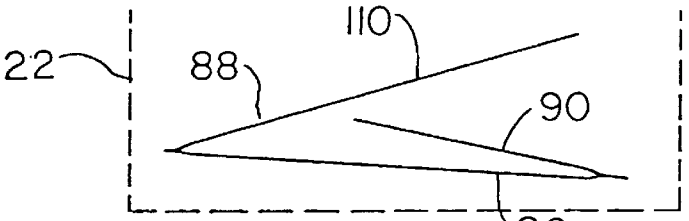
Figure 8C:
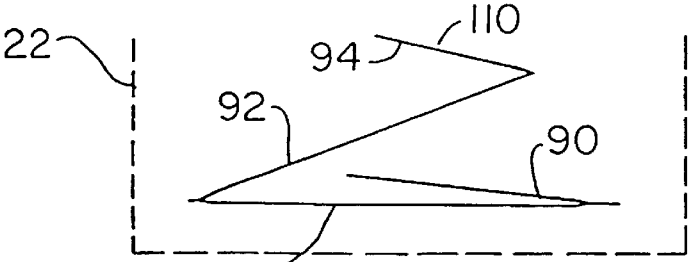
Figure 8D:
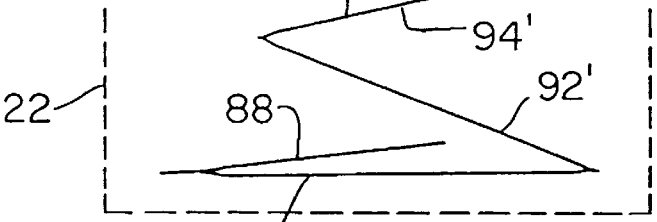
Figure 8E:
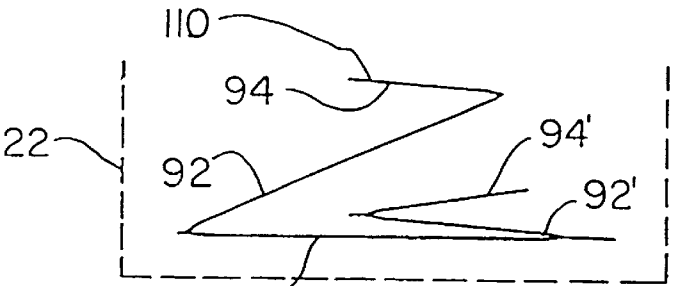
Figure 8F:
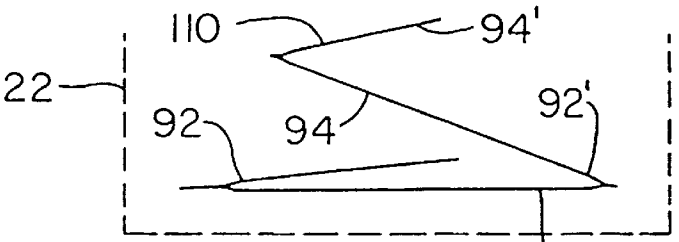
Figure 8J:
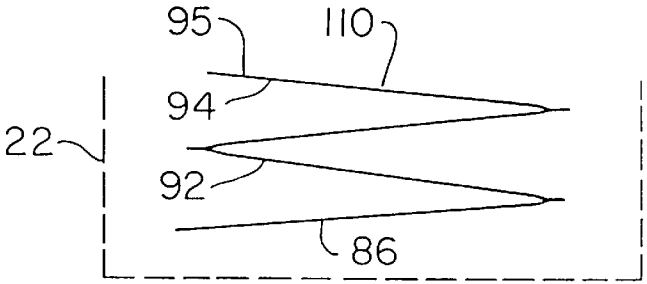
Figure 8K:
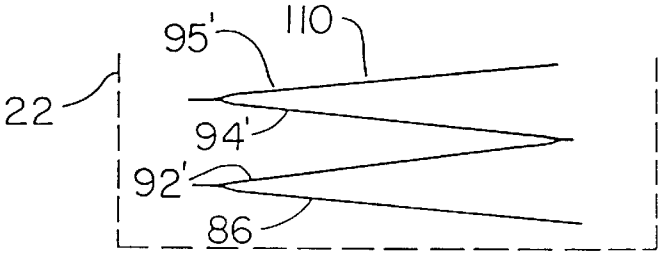
Figure 8L:
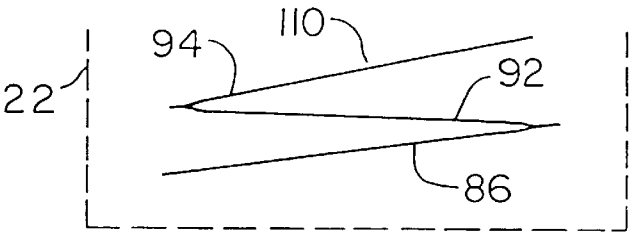
Figure 8G:
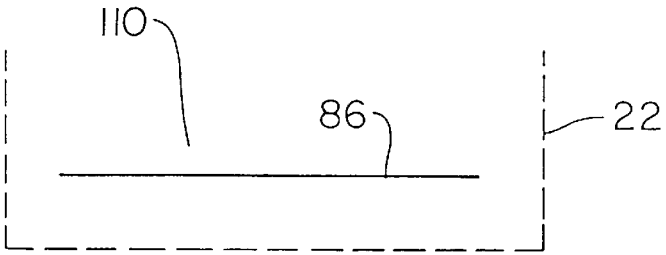
Figure 8H:
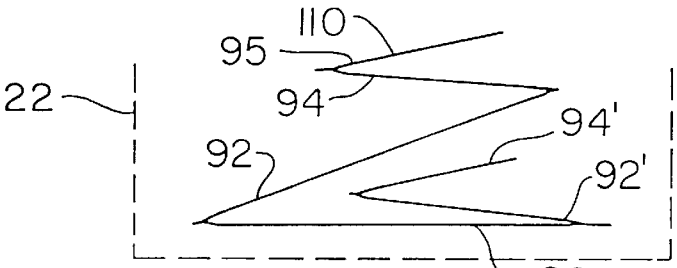
Figure 8I:
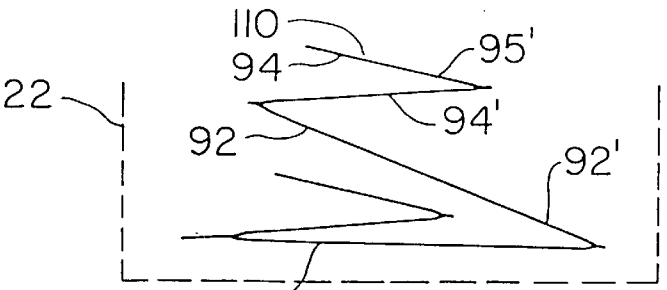
Figure 8O:
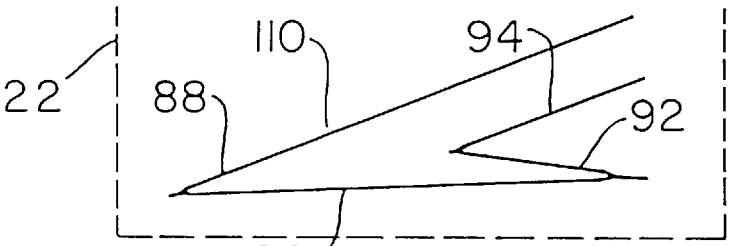
Figure 8P:
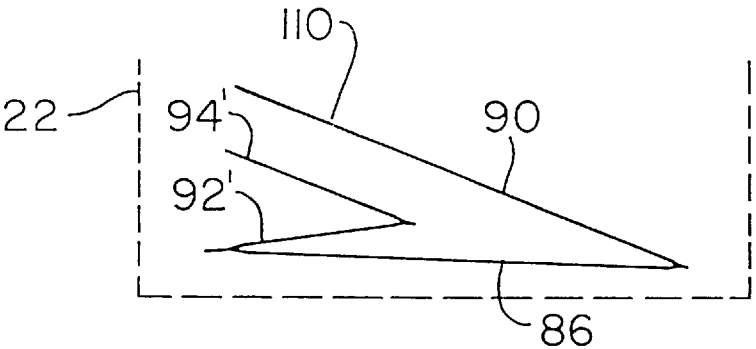

Various folded paper configurations currently envisioned by the inventors are depicted broadly in FIGS. 8*a*–8*p*. Each fold will be discussed briefly below.

FIG. 8*a* depicts a simple fold comprising a base 86, first side flap 88, and second side flap 90. In this configuration, the second (or right) side flap 90 lies has over the first (or left) side flap 88.

FIG. 8*b* depicts a simple fold which is the reverse of the configuration depicted in FIG. 8*a*.

FIG. 8*c* depicts another fold, identical to the fold shown in FIG. 6*c* comprising a base 86, side flap 90, and side flap 88 folded into subflaps 92 and 94.

FIG. 8*d* depicts a fold which is the reverse of the configuration depicted in FIG. 8*c*, with the sideflap 90 folded into side flaps 92' and 94'.

FIG. 8*e* depicts a Z-fold, comprising a base 86. Each aside flap has been folded into a pair of subflaps 92, 94, and 92', 94'.

FIG. 8*f* depicts a fold which is the reverse of the configuration depicted in FIG. 8*e*.

FIG. 8*g* depicts a configuration in which the folding bar and guide plough have been removed, so that no folds or creases are applied to the paper web. In this configuration, the paper section 110 consists only of a base 86.

FIG. 8*h* depicts a configuration created by attaching yet another guide plough to one side of the folding station in order to create a third subflap 95.

FIG. 8*i* depicts a configuration which is the reverse of the configuration depicted in FIG. 8*h*.

FIG. 8*j* depicts an accordion fold, created by removing the folding bar and guide ploughs from one side of the folding station, and attaching one folding bar and two guide ploughs to the other side of the folding station. This folding station arrangement creates a paper section having a base 86, with no side flaps on one side, and the other side folded into three subflaps 92, 94 and 95.

FIG. 8*k* depicts a configuration which is the reverse of the configuration depicted in FIG. 8*j*.

FIG. 8*l* depicts a fold created by removing the folding bar and guide ploughs from one side of the folding station, and attaching one folding bar and one guide plough to the other side of the folding station. This folding station arrangement creates a paper section having a base 86, with no side flap on one side, and the other side folded into two subflaps 92 and 94.

Figure 8M:
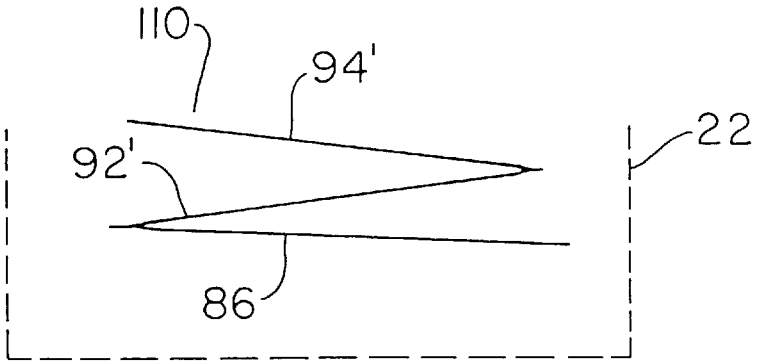

FIG. 8*m* depicts a configuration which is the reverse of the configuration depicted in FIG. 81.

Figure 8N:
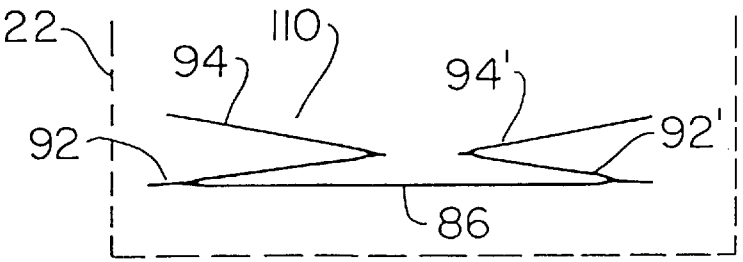

FIG. 8*n* depicts a "narrow Z-fold" in which a folding bar and guide plough is provided on each side of the folding station, or that each side flap is folded into subflaps 92, 94, and 92', 94'.

FIG. 8*o* depicts a "left arrow" configuration including a base 86, one side flap 88, and the other side flap folded into subflaps 92, 94.

FIG. 8*p* depicts a configuration which is the reverse of the configuration depicted in FIG. 8*o*.

To complete the folding step, a pair of nip rolls 96 are provided, as broadly depicted in FIG. 3, to firmly press the folded paper web 64 together for further processing.

In accordance with the invention, a step is provided of cutting a paper section off of the paper web, the paper section having leading and trailing edges of the paper section and a second length L2 between the leading and trailing edges, than the first length L1 of the carton blank. As broadly embodied herein, and referring to FIG. 1, a rotating cutting cylinder 100 is provided, having a plurality of cutting blades 102 projecting therefrom. Preferably, the number of cutting blades 102 is adjustable.

As embodied in FIG. 1, cutting cylinder 100 rotates alongside a rotating vacuum drum 104, such that cutting blade 102 contacts an anvil 106. Paper web 64, after passing between nip rolls 62, threads between cutting cylinder 100 and vacuum drum 104. Cutting blade 102 then slices a paper section 110 from web 64. Paper section 110 is then held against the surface of vacuum drum 104 by suction by vacuum pump 28 via vacuum manifold 112 and a plurality of apertures in the surface of vacuum drum 104.

Referring to FIGS. 4*b*, 5*b*, and 6*b*, the cutting of paper section 110 from paper web 64 creates a section having a leading edge 114 and trailing edge 116. A length L2 is defined between the leading and trailing edges. The paper section 110 depicted in these drawings further has the base portion 86, first and second side flaps 88 and 90, and first and second creases 87 and 89.

Preferably, as embodied in FIGS. 4–6, paper section length L2 is greater than length L1 of the base surface of carton blank 22, and paper section width W2 is less than carton blank base surface width W1. Preferred dimensions of the paper sections for given carton blanks will now be discussed. For example, as broadly depicted in FIG. 4*b*, for a carton blank having a width W1 of 8.5" between side edge 36 and 38, a paper width W2 of 8" is preferred. For a carton length L1 of 11.5" between end edges 32 and 34, a paper length L2 of 12" between leading and trailing edges 114 and 116 is preferred.

For different styles of boxes, it may be preferred to cut the paper section so that L2 of the paper is less than or equal to L1 of the carton blanks. This length is determined by box style and customer desire.

It will be understood that with these dimensions, the base and folds of the paper lining in the width direction will be clear of the creases and flaps of the carton in the width direction when the carton is assembled. This feature is explained in further detail below. The invention is not limited, however, to any specific dimension or clearances.

In accordance with the invention, a step is provided of inserting the paper section with the carton blank such that the first crease of the base of the paper section, and either the second crease or opposite edge of the base of the paper section, are spaced a preselected distance inward from the first and second side edges of the carton blank.

As broadly embodied in FIG. 1, each paper section 110, after being cut from web 64, is held against the surface of drum 104 by the force of vacuum drawn thereon. The paper section is then pressed between drum 104 and carton blank 22. When adhesive has been applied to the carton blank, the paper 110 adheres to adhesive line 62.

The preferred position of the paper section 110 against the respective carton blank 22 can be extrapolated from an examination of FIGS. 4*a*, 4*b*, 5*a*, 5*b*, 6*a*, 6*b*, and 7*a*–7*r* and 7*a*1–7*d*1. For example, referring to FIGS. 4*a* and 4*b*, for a carton blank having width W1 of 8.5" between side edges 36 and 38, and a length L1 of 11.5" between leading and trailing edges 32 and 34, the base portion 86 of the respective paper section, having a width W2 of 8" is provided, leaving a ¼" clearance between each of paper creases 87, 89, and each of box side edges 36 and 38. Conversely, a ¼ overlap is provided between each of the paper leading and trailing ends 114, 116, and each of the carton leading and trailing ends 32 and 34.

As another example, referring to FIGS. 5*a* and 5*b*, for a carton blank having a width W1 of 7.75" between side edges 136 and 38, and a length L1 of 7.75" between leading and trailing ends 32 and 34, the respective paper section having a base width dimension of 7.5" and a length L2 of 8.25" is provided, leaving a ⅛" clearance between each of paper creases 87 and 89 and each of carton side edges 36 and 38, and an overlap of ¼" between each of the paper leading and trailing edges 114 and 116 and each of the carton leading and trailing ends 32 and 34.

Similar clearances are provided with the carton and paper configuration shown in FIGS. 6*a* and 6*b*.

As shown in FIGS. 7*b*, 7*l*, and 7*p*, paper section width W2 is selected, and the paper is inserted, such that each side edge of the paper is inset ¼" from the corresponding side edges 36, 38 of the carton bottom surface. Paper section length L2 is selected, and the paper is inserted, such that the leading end of the paper aligns with the leading edge 32 of the box, but the trailing end of the paper overlaps trailing edge 34 of the box by ¼".

As shown in FIGS. 7*c*–7*k*, 7*q*, and 7*r*, the width W2 of the paper is selected, and the paper is inserted, such that each side edge of the paper is inset ¼" from the corresponding side edge 36, 38 of the carton blank. Paper section length L2 is selected, and the paper is inserted, such that the leading and trailing ends of the paper align with the leading and trailing edges of the box.

As shown in FIG. 7*m*, the width W2 of the paper is selected, and the paper is inserted, such that each side edge of the paper is inset ¼" from the corresponding side edges 36, 38 of the carton blank. Paper section length L2 is selected, and the paper is inserted, such that the leading end of the paper aligns with leading edge 32 of the box, but the trailing end of the paper is inset ¾" from the trailing edge 34 of the box.

As shown in FIGS. 7*n* and 7*o*, the width W2 of the paper is selected, and the paper is inserted, such that each side edge of the paper is inset ¼" from the corresponding side edges 36, 38 of the carton blank. Paper section length L2 is selected, and the paper is inserted, such that the leading and trailing ends of the paper overlap the leading and trailing edges 32, 34 of the box by ¼".

The clearances are provided so that when the carton blank is subsequently folded, and later unfolded for assembly of the box, the carton flaps will slide free of the paper, thereby avoiding crumpling or tearing the paper.

In accordance with the invention, a step may be provided of folding leading and trailing end flaps of the carton blank, and first and second side flaps of the carton blank, over the paper section. As broadly embodied in FIG. 1, carton blank 22 with affixed paper section 110 proceeds on belt 26 to a flap folding section 120. Flap folding section 120 includes a series of rollers 122, as are well known in the art, for lifting and folding box flaps 33, 35, 37 and 39 over the paper lining section 110.

After passing through nip rolls 122, the folded carton blank and interior paper lining may pass into right angle turn section 124, where the folded carton is turned 90° and sent down belt 126 for final processing. This step occurs only in a right-angle machine. In other cases, where no right-angle turn is required, the right angle section 124 can be eliminated.

Figure 9:
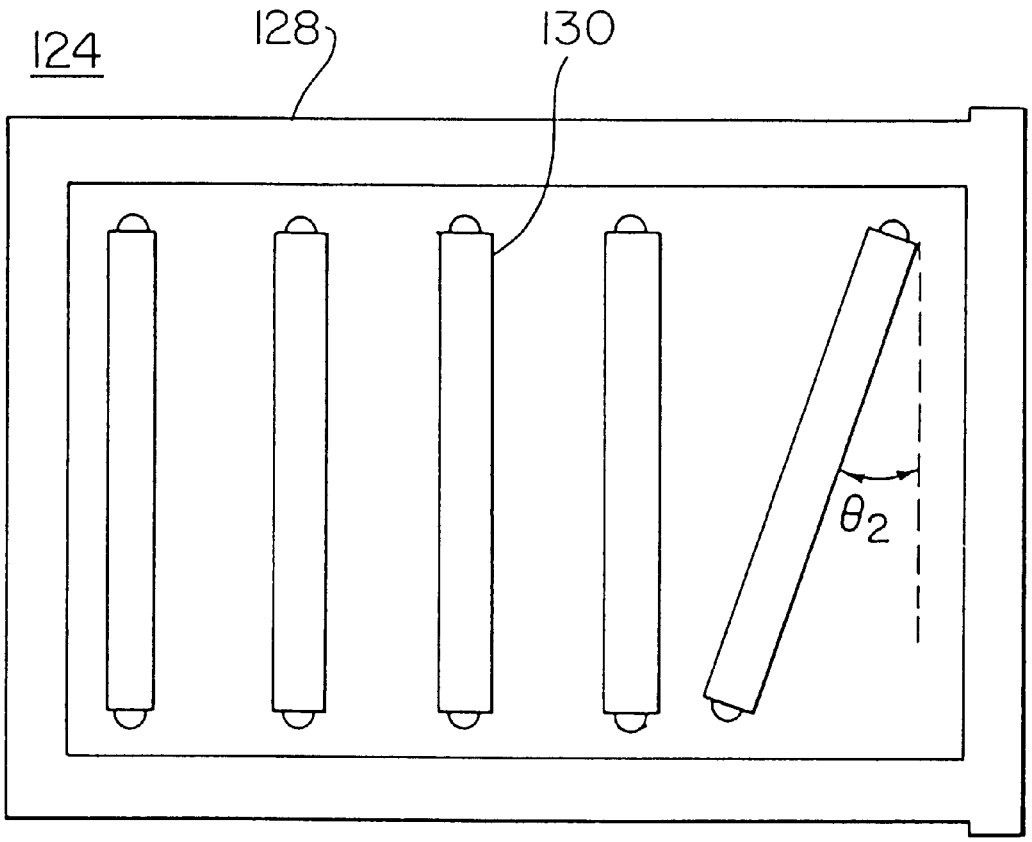
FIG. 9 is a top view of a portion of the apparatus of FIG. 1 used to reroute the carton blank and affixed paper lining.
Figure 10:
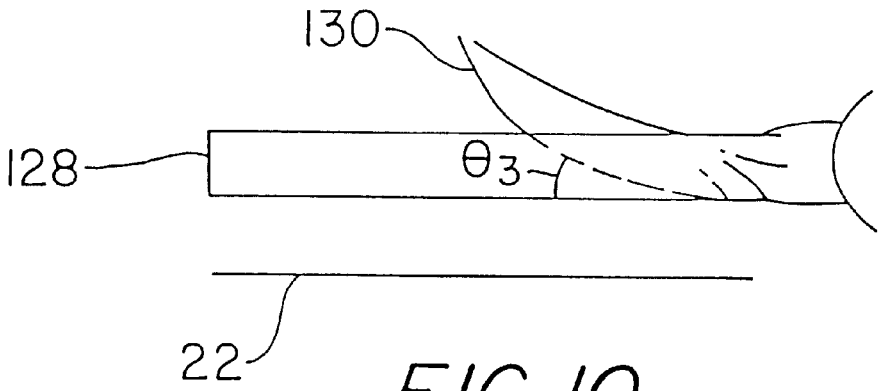
FIG. 10 is a partial side view of the apparatus depicted in FIG. 9.
Figure 11:
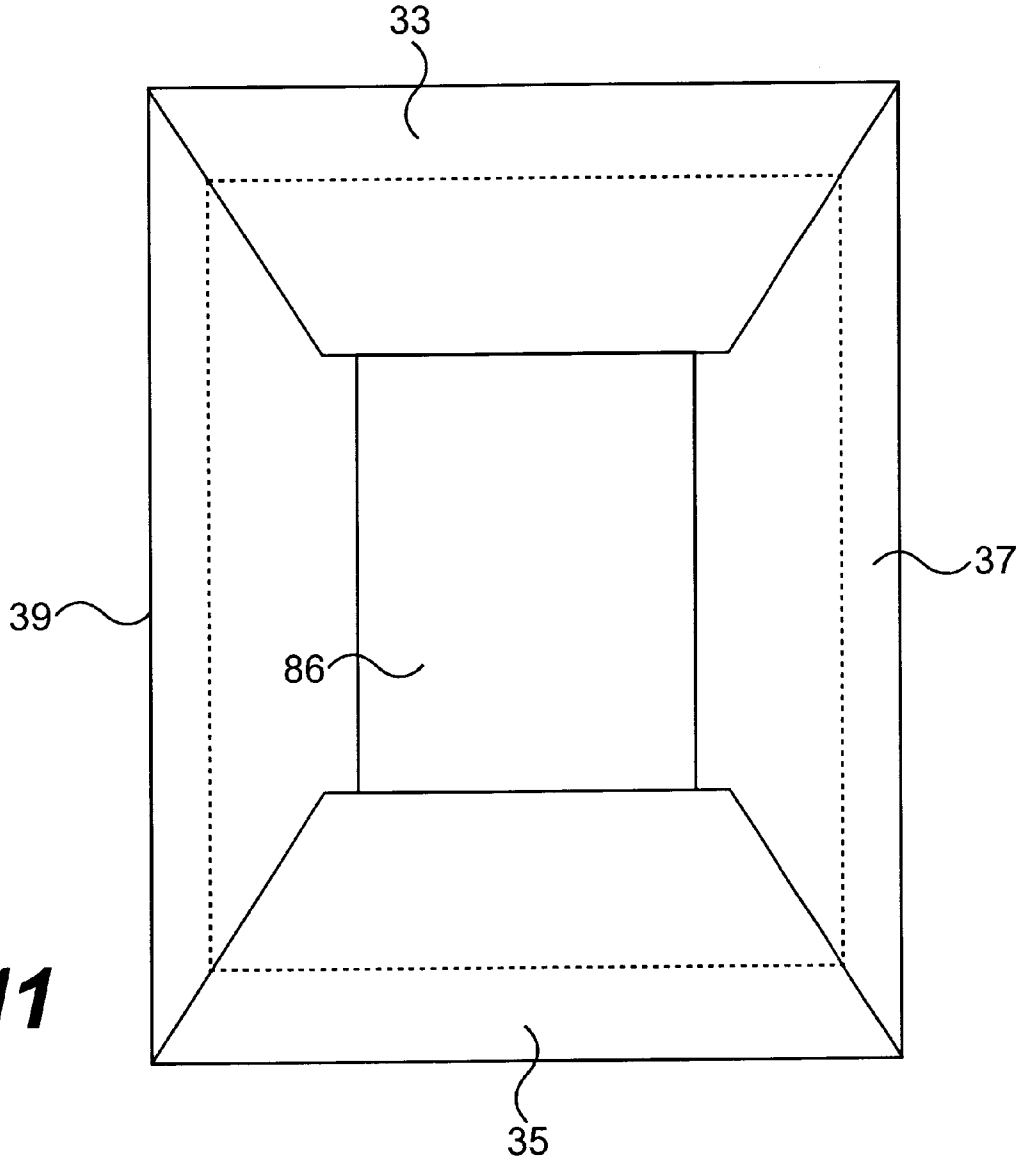
FIG. 11 is a top view of a carton blank with tissue paper insert, prior to assembly of the carton, with the flaps of the carton blank folded over the tissue paper.

When a right angle turn is required, and as shown in FIGS. 9 and 10, right angle turn section 124 includes a frame 128 and a plurality of slats 130 bolted to the frame. Preferably, at least one of slats 130 is tilted at an angle $\theta_2$, of approximately 15° from the vertical. In addition, it is preferred that the slats are tilted at an angle $\theta_3$ of approximately 5–10° from the horizontal. It has been found that these angles of inclination for the slats are ideal for enabling the slats to hold the paper lining down during the right angle turn of the carton, while at the same time avoiding tearing the paper.

The process and apparatus described above allows preparation of carton blanks having a prefolded paper lining. The carton blank can be unfolded and assembled into gift boxes in stores, with a folded tissue paper lining already inserted. Because of the placement of the paper in the carton blank, with clearance provided between box creases and paper creases, the paper will not be crumpled or torn upon box assembly. The novel method of applying adhesive to the carton blank surface, and of using release-type adhesive, results in the paper lining being fixed in place, but easily removable if the customer does not want a paper lining. The novel method of folding the paper web serves to prevent damage to the paper during the preparation process. When a right angle machine is used, the novel use of angled slats in the right angle turn section also prevents damage to the paper during the preparation process.

The above-described apparatus and process consequently produces superior carton blanks with prefolded interior paper linings, with far less waste, and consequently a lower cost.

The foregoing description of preferred embodiment of the invention has been presented for purposes of illustration and description. It is not intended to be exhaustive or to limit the invention to the precise form disclosed, and modifications and variations are possible in light of the above teachings, or may be acquired from practice of the invention. The embodiments were chosen and described in order to explain the principles and the practical application of the invention, to enable one skilled in the art to utilize the invention in various embodiments and with various modifications as are suited to the particular use contemplated. It is intended that the scope of the invention be defined by the claims attached hereto, and their equivalents.

We claim:

1. A carton assembly configured to be assembled into a carton having a prefolded interior paper lining, comprising:

a carton blank having a base surface, the base surface having leading and trailing edges, and first and second side edges, and leading and trailing end folds inset from the leading and trailing edges, defining leading and trailing end flaps, and first and second side folds inset from the first and second side edges defining first and second side flaps, the carton blank base surface further having a first length between the leading and trailing end folds and a first width between the first and second side folds, each of said leading and trailing end flaps being connected to said first and second side flaps; and a paper section having a base portion, a first side flap, and an opposite edge, the first side flap joining the base portion at at least one crease, the base portion of said paper section having a second width between the at least one crease and the opposite edge that is less than the first width of said carton blank, said paper section base portion further having leading and trailing edges and a second length between the leading and trailing edges of the paper section;

wherein said paper section is placed on said carton blank to define the interior paper lining such that the at least one crease of the base of said paper section is spaced a preselected distance inward from the first and second side folds of said carton blank and said paper section is unattached to said first and second side flaps of said carton blank, and wherein said leading end flap, said trailing end flap, said first side flap and said second side flap of said carton blank are folded inwardly and configured to be folded outwardly to a substantially vertical position for assembly of said carton blank into the carton.

2. The carton assembly 1, wherein said paper section is affixed to said carton blank with an adhesive.

3. The carton assembly of claim 2, wherein the adhesive is a non-permanent release type adhesive.

4. The carton assembly of claim 1, wherein said paper section comprises a plurality of paper web portions.

5. The carton assembly of claim 1, wherein the first side flap of said paper section includes first and second subflaps joined together by a crease.

6. The carton assembly of claim 1, wherein said carton blank includes leading and trailing end flaps folded over said paper section.

7. The carton assembly of claim 1, wherein said first and second side flaps are folded over said paper section.

8. The carton assembly of claim 1, wherein said paper section includes a second side flap joining the base portion of said paper web at a second crease corresponding to the opposite edge.

9. The carton assembly of claim 8, wherein the second side flap of said paper section includes first and second subflaps joined together by a crease.

10. The carton assembly of claim 1, wherein the second length of the paper section base portion is greater than the first length of said carton blank.

11. The carton assembly of claim 1, wherein the second length of said paper section base portion is less than or equal to the first length of said carton blank.

12. The carton assembly of claim 1, wherein said paper section is placed on said carton blank such that, upon assembly of the carton, the carton flaps slide free of said paper section, avoiding crumpling of said paper section.

* * * * *

UNITED STATES PATENT AND TRADEMARK OFFICE

CERTIFICATE OF CORRECTION

PATENT NO. : 6,305,600 B1
DATED : October 23, 2001
INVENTOR(S) : Urban C. Hirschey et al.

It is certified that error appears in the above-identified patent and that said Letters Patent is hereby corrected as shown below:

Column 10, claim 2,
Line 24, "assembly 1" should read -- assembly of claim 1 --.

Signed and Sealed this

Fifth Day of March, 2002

*Attest:*

*Attesting Officer*

JAMES E. ROGAN
*Director of the United States Patent and Trademark Office*